US012297064B1

(12) United States Patent
Fuji et al.

(10) Patent No.: US 12,297,064 B1
(45) Date of Patent: May 13, 2025

(54) IMAGE READING DEVICE

(71) Applicant: SEIKO EPSON CORPORATION, Tokyo (JP)

(72) Inventors: Keita Fuji, Nakama (JP); Kazuhito Noda, Kitakyushu (JP)

(73) Assignee: SEIKO EPSON CORPORATION, Tokyo (JP)

( * ) Notice: Subject to any disclaimer, the term of this patent is extended or adjusted under 35 U.S.C. 154(b) by 172 days.

(21) Appl. No.: 17/937,045

(22) Filed: Sep. 30, 2022

(51) Int. Cl.
*B65H 1/26* (2006.01)
*B65H 3/06* (2006.01)

(52) U.S. Cl.
CPC ..... *B65H 3/063* (2013.01); *B65H 2404/61* (2013.01)

(58) Field of Classification Search
CPC ..... B65H 3/063; B65H 1/266; B65H 1/04; B65H 2404/61
See application file for complete search history.

(56) References Cited

U.S. PATENT DOCUMENTS 5,111,252 A * 5/1992 Hamada ..... B65H 31/00 271/213
5,793,177 A * 8/1998 Chia ..... B65H 5/00 318/685
7,618,038 B2 * 11/2009 Aida ..... B65H 1/04 271/145
9,890,000 B2 * 2/2018 Sugiyama ..... B65H 3/0661
2014/0367909 A1 * 12/2014 Wang ..... B41J 13/10 271/171

FOREIGN PATENT DOCUMENTS

JP H10035896 A 2/1998
JP 2018076159 A 5/2018

OTHER PUBLICATIONS

Office Action for JP Patent Application No. 2021160808, issued on Feb. 25, 2025, 6 pages.

* cited by examiner

*Primary Examiner* — Thomas A Morrison
(74) *Attorney, Agent, or Firm* — CHIP LAW GROUP

(57) ABSTRACT

An image reading device includes an original-document support portion configured to support an original document to be fed, and an expansion support portion configured to be able to be expanded from and accommodated in the original-document support portion. The expansion support portion includes a first expansion portion extending along a width direction that is a direction intersecting an original-document feeding direction in a state of being accommodated in the original-document support portion, and a second expansion portion configured to be able to be accommodated in and expanded from the first expansion portion, the second expansion portion extending along the width direction in a state in which the expansion support portion is accommodated.

3 Claims, 19 Drawing Sheets

IMAGE READING DEVICE

The present application is based on, and claims priority from JP Application Serial Number 2021-160808, filed on Sep. 30, 2021, the disclosure of which is hereby incorporated by reference herein in its entirety.

BACKGROUND

1. Technical Field

The present disclosure relates to an image reading device that reads an image on an original document.

2. Related Art

There is a sheet feeding type scanner serving as one example of an image reading device. The term "scanner" used below represents a sheet feeding type scanner. In some cases, the scanner includes a supply tray configured to support a sheet that has been fed, as described in JP-A-2018-076159. A sub-supply tray is configured to be able to be pulled out toward the upper direction from the supply tray.

In recent years, in some cases, the sheet feeding type scanner is required to have a significantly reduced size so as to be able to be installed, for example, on a narrow desk top. In such cases, in association of the significant reduction in the size of the entire device, the sub-supply tray as described above also has a reduced size in the feeding direction, and hence, cannot appropriately support the original document that has been fed.

SUMMARY

In order to solve the problem described above, an image reading device according to the present disclosure includes a device main body including a reading unit configured to read an image at an original document that is conveyed, an original-document support portion disposed upstream of the reading unit and configured to support the original document that is to be fed, and an expansion support portion configured to be accommodated in and expanded from the original-document support portion, and be expanded from the original-document support portion to support, together with the original-document support portion, the original document to be fed, in which the expansion support portion includes a first expansion portion extending along a width direction that is a direction intersecting an original-document feeding direction in a state of being accommodated in the original-document support portion, the first expansion portion being configured to rotate relative to the original-document support portion, thereby being expanded and accommodated, and a second expansion portion extending along the width direction in a state where the expansion support portion is accommodated, the second expansion portion being configured to be accommodated in and expanded from the first expansion portion.

DESCRIPTION OF EXEMPLARY EMBODIMENTS

Figure 1:
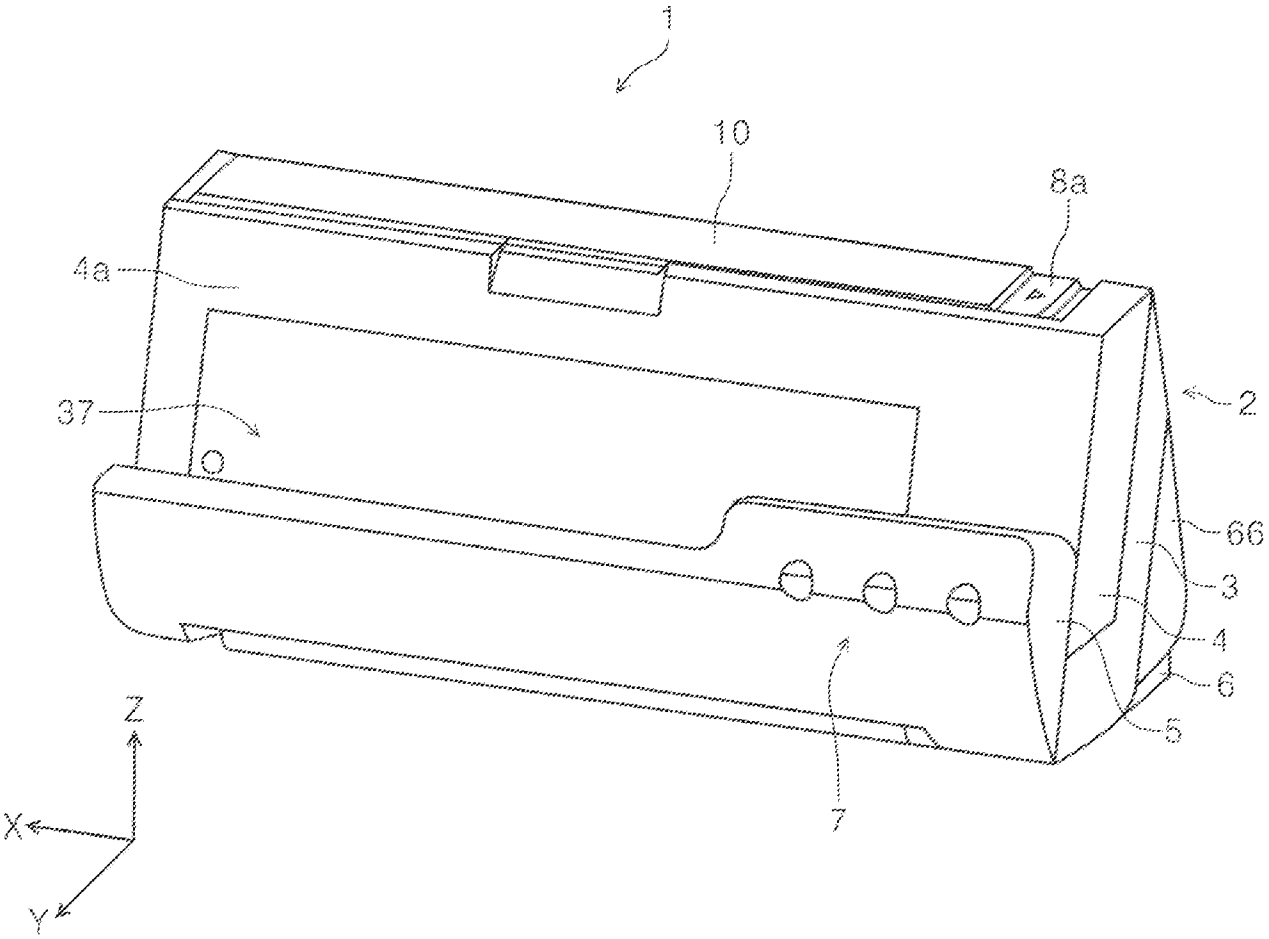
FIG. 1 is a perspective view illustrating the scanner as viewed from the front, the scanner including a device main body in a standard reading posture.

Below, the present disclosure will be schematically described.

An image reading device according to a first aspect includes: a device main body including a reading unit configured to read an image at an original document that is conveyed; an original-document support portion disposed upstream of the reading unit and configured to support the original document that is to be fed; and an expansion support portion configured to be accommodated in and expanded from the original-document support portion, and be expanded from the original-document support portion to support, together with the original-document support portion, the original document to be fed, in which the expansion support portion includes: a first expansion portion extending along a width direction that is a direction intersecting an original-document feeding direction in a state of being accommodated in the original-document support portion, the first expansion portion being configured to rotate relative to the original-document support portion, thereby being expanded and accommodated; and a second expansion portion extending along the width direction in a state where the expansion support portion is accommodated, the second expansion portion being configured to be accommodated in and expanded from the first expansion portion.

With the present aspect, the expansion support portion includes the first expansion portion and the second expansion portion extending along the width direction that is a direction intersecting the original-document feeding direction in a state of being accommodated in the original-document support portion, and the first expansion portion and the second expansion portion are configured to rotate relative to the original-document support portion, thereby being able to be expanded and be accommodated. Thus, when the dimension in the original-document feeding direction cannot be sufficiently obtained, the dimension in the width direction that is a direction intersecting the original-document feeding direction is used, thereby being able to sufficiently obtain the size, in the original-document feeding direction, of the first expansion portion and the second expansion portion at the time of being expanded. This makes it possible to appropriately support the original document while reducing the size of the device.

In the first aspect, a second aspect is configured such that the expansion support portion includes a third expansion portion that is an expansion portion configured to be accommodated in and expanded from the second expansion portion and extending along the width direction in a state in which the expansion support portion is accommodated.

With the present aspect, the expansion support portion includes the third expansion portion that is able to be accommodated in and expanded from the second expansion portion. Thus, it is possible to further sufficiently obtain the size of the expansion support portion in the original-document feeding direction.

In the second aspect, a third aspect is configured such that the second expansion portion is configured to rotate relative to the first expansion portion, thereby being expanded from and accommodated in the first expansion portion, and the third expansion portion is configured to rotate relative to the second expansion portion, thereby being expanded from and accommodated in the second expansion portion.

For example, in a case of a configuration in which the second expansion portion slides relative to the first expansion portion, thereby being expanded from and accommodated in the first expansion portion, the first expansion portion needs to retain the second expansion portion in a slidable manner. Thus, the width of the first expansion portion is wider than that of the second expansion portion. In other words, the width of the second expansion portion is narrower than the width of the first expansion portion. This similarly applies to the relationship between the third expansion portion and the second expansion portion. Thus, when both the second expansion portion and the third expansion portion are of a slide type, the width of the expansion support portion reduces from the base end toward the free end. This results in a configuration in which the area for supporting the original document reduces, which is not preferable.

However, the present aspect employs a configuration in which, in addition to the first expansion portion, the second expansion portion and the third expansion portion also rotate, thereby being accommodated and expanded. This makes it possible to sufficiently obtain the widths of the second expansion portion and the third expansion portion, which makes it possible to appropriately support the original document.

In the third aspect, a fourth aspect is configured such that: the expansion support portion includes two expansion support portions provided with a center position of the original-document support portion in the width direction being interposed between the two expansion support portions; when the original-document support portion is viewed from a front, and the expansion support portion at a right side relative to the center position is referred to as a right-side expansion support portion, the expansion support portion at a left side relative to the center position is referred to as a left-side expansion support portion; the right-side expansion support portion extends right upward toward upstream in the original-document feeding direction in an extended state; and the left-side expansion support portion extends left upward toward upstream in the original-document feeding direction in an extended state.

With the present aspect, the right-side expansion support portion extends right upward toward the upstream in the original-document feeding direction, and the left-side expansion support portion extends left upward toward the upstream of the original-document feeding direction. Thus, it is possible to support the original document with a wide area along the width direction at the upstream of the original-document feeding direction.

In the fourth aspect, a fifth aspect is configured such that: a free end of the third expansion portion is exposed in a half-expanded state in which the first expansion portion is expanded and the second expansion portion and the third expansion portion are accommodated in the right-side expansion support portion and the left-side expansion support portion; in the left-side expansion support portion, by displacing the free end of the third expansion portion in a first direction that is a direction away from the right-side expansion support portion in the half-expanded state, the second expansion portion and the third expansion portion are expanded in a region in the first direction relative to a center of rotation of the second expansion portion; and in the right-side expansion support portion, by displacing the free end of the third expansion portion in a second direction that is a direction away from the left-side expansion support portion in the half-expanded state, the second expansion portion and the third expansion portion are expanded in a region in the second direction relative to a center of rotation of the second expansion portion.

With the present aspect, in the left-side expansion support portion, by displacing the free end of the third expansion portion in the first direction that is a direction away from the right-side expansion support portion in the half-expanded state, the second expansion portion and the third expansion portion are expanded in a region in the first direction relative to the center of rotation of the second expansion portion. Thus, the right-side expansion support portion is less likely to be an obstacle, which leads to an improvement in operability. This similarly applies to the right-side expansion support portion. With this configuration, either one of the left-side expansion support portion and the right-side expansion support portion is less likely to be an obstacle to the other, which leads to an improvement in operability.

In the fifth aspect, a sixth aspect is configured such that the right-side expansion support portion and the left-side expansion support portion are configured to be switched between a first state and a second state by rotation of the first expansion portion relative to the original-document support portion, the first state being a state of extending straight in a direction intersecting the original-document feeding direction, the second state being a state of extending straight along the original-document feeding direction.

With the present aspect, by rotation of the first expansion portion relative to the original-document support portion, the right-side expansion support portion and the left-side expansion support portion are configured to be switched between the first state of extending straight in a direction intersecting the original-document feeding direction and the second state of extending straight along the original-document feeding direction. Thus, in the second state, it is possible to appropriately support the original document having a small dimension in the width direction.

In any one of the first to sixth aspects, a seventh aspect is configured such that the original-document support portion is provided so as to be rotatable relative to the device main body, and rotates to switch between a state of being accommodated in the device main body and a state of supporting an original document.

With the present aspect, the original-document support portion is provided rotatably relative to the device main body, and rotates to be able to switch between a state of being accommodated in the device main body and a state of being able to support the original document. This makes it possible to reduce the space for installing the device when the device is not in use.

Below, the present disclosure will be specifically described.

In the following description, a scanner 1 will be given as an example of an image reading device, by way of example. The scanner 1 is able to read at least one surface of a first surface of an original document and a second surface that is opposite to the first surface. The scanner 1 is a so-called sheet feeding type scanner that performs reading while moving the original document relative to a reading unit that will be described later.

In the present specification, the original document includes not only a sheet-shaped original document but also a card-shaped original document and a booklet-shape original document.

Note that the X-Y-Z coordinate system illustrated in each of the drawings is set such that the X-axis direction is a width direction of the device and also is a width direction of the original document. The Y-axis direction is a depth direction of the device. The Z-axis direction is a direction along the vertical direction. In the present embodiment, the +Y direction is a direction from the back face of the device toward the front face, and the −Y direction is a direction from the front face of the device toward the back face. In addition, the +X direction is a left direction as viewed from the front face of the device, and −X direction is a right direction.

Furthermore, in the description below, a direction in which the original document is conveyed may be referred to as "downstream", and a direction opposite to this direction may be referred to as "upstream".

Figure 2:
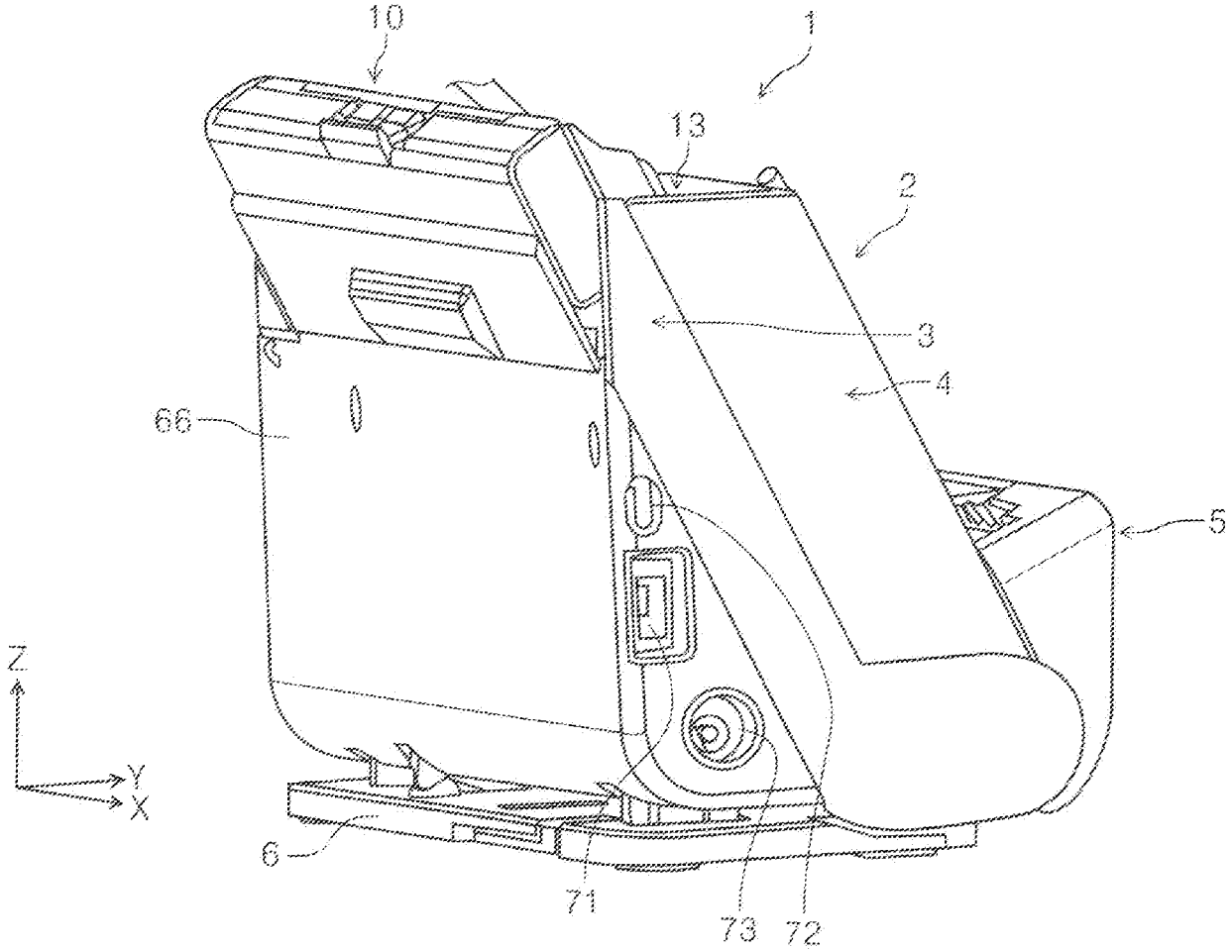
FIG. 2 is a perspective view illustrating the scanner as viewed from the rear, the scanner including the device main body in the standard reading posture.

In FIGS. 1 and 2, the scanner 1 includes a device main body 2, and a main-body support portion 6 configured to rotatably support the device main body 2.

The device main body 2 is configured to include a first unit 3, a second unit 4, and a third unit 5.

Figure 3:
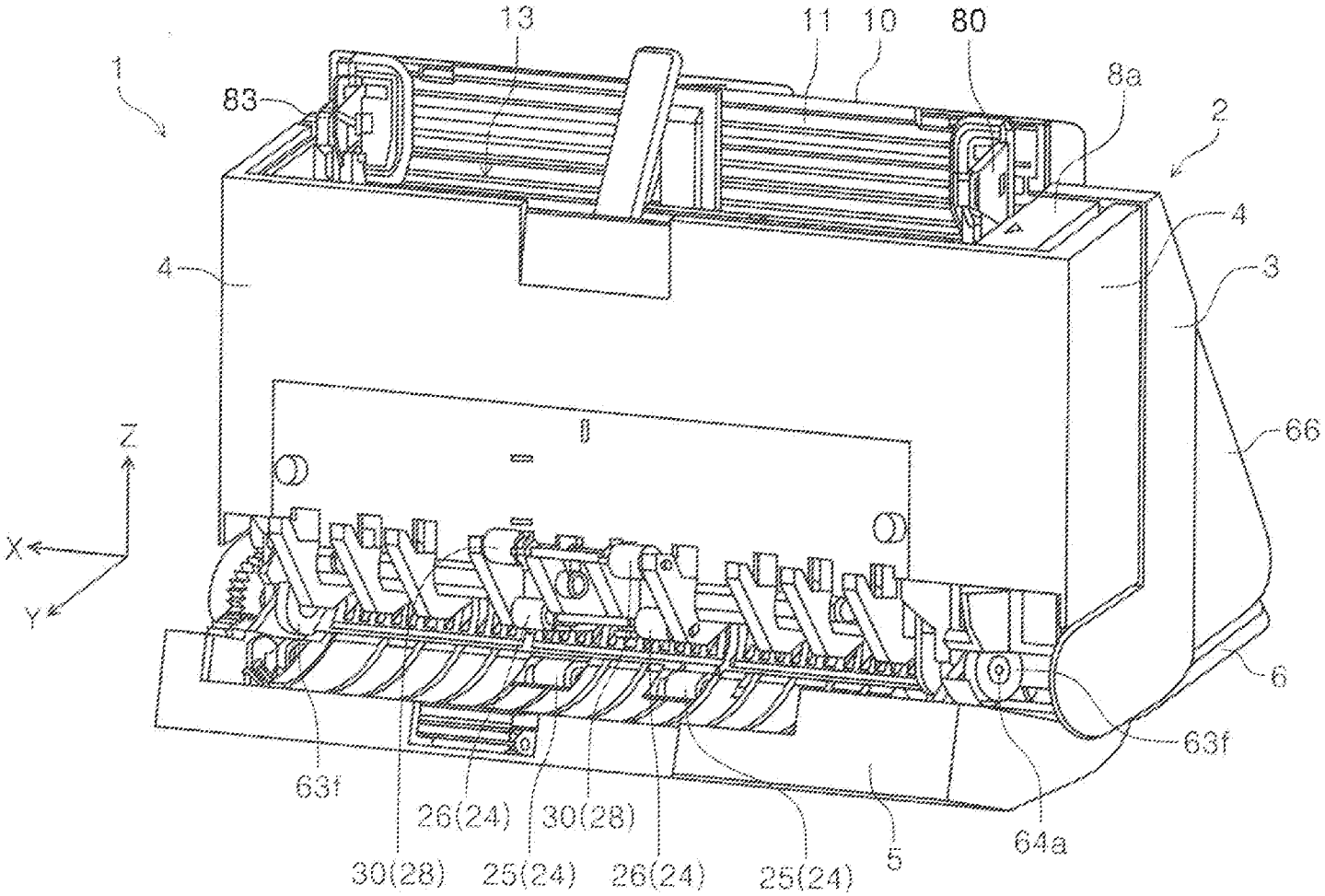
FIG. 3 is a perspective view illustrating the scanner as viewed from the front, in which the device main body is in the standard reading posture and a third unit is opened.

The second unit 4 and the third unit 5 are provided so as to be able to rotate with a frame rotary shaft 64*a* being the center (see FIG. 3). The frame rotary shaft 64*a* is a rotary shaft that constitutes the rotary shaft center parallel to the X-axis direction.

Figure 4:
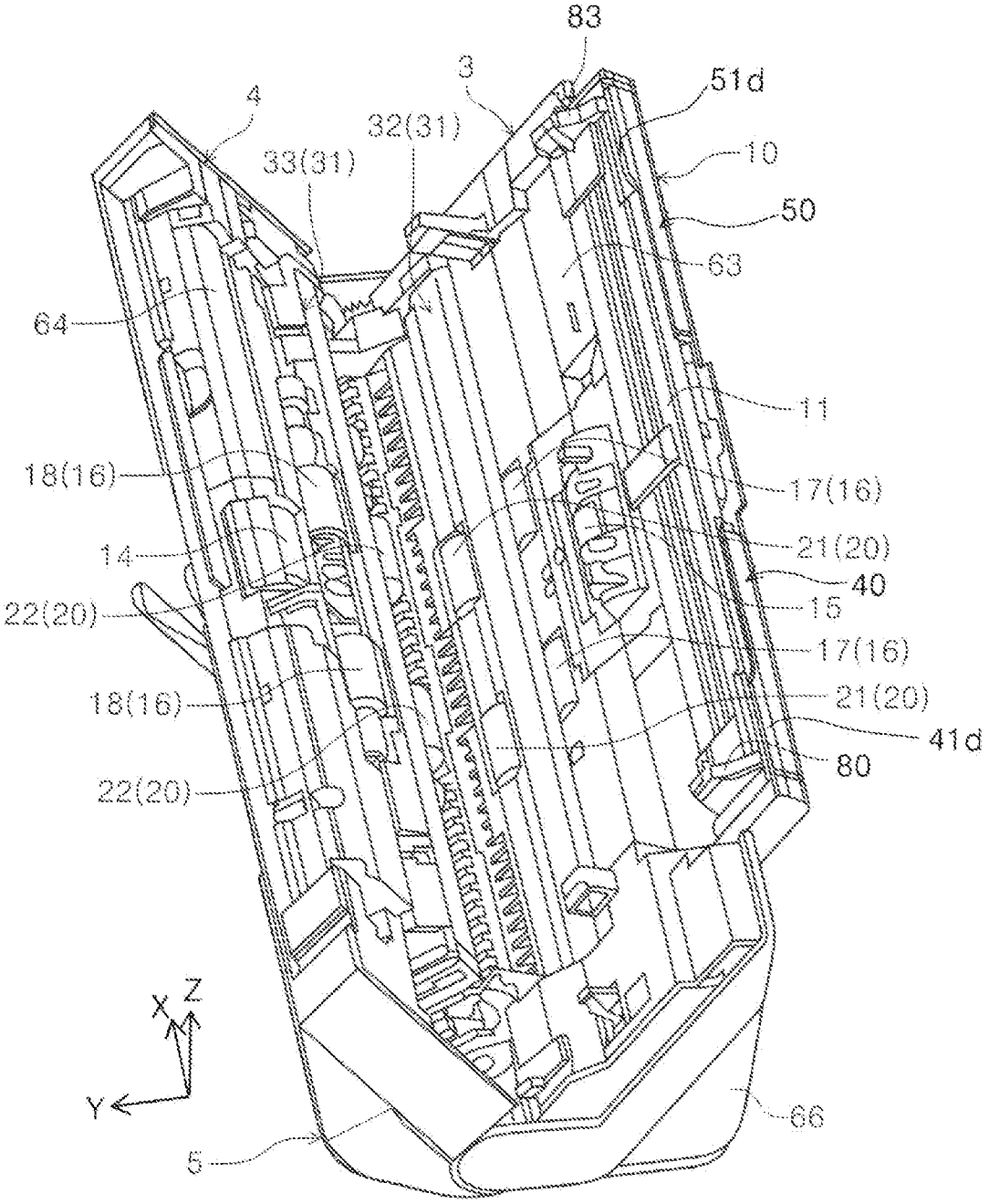
FIG. 4 is a perspective view illustrating the scanner as viewed from above, in which the device main body is in the standard reading posture and a second unit is opened.

The second unit 4 and the third unit 5 are able to integrally rotate relative to the first unit 3 with the frame rotary shaft 64*a* being the center (see FIG. 4). By causing the second unit 4 and the third unit 5 to rotate relative to the first unit 3, it is possible to cause part of the original-document conveying path to be exposed as illustrated in FIG. 4. In particular, it is possible to expose an original-document feeding path R1 and a reading conveying path R2 that will be described later. By sliding a lock release portion 8*a* toward the −X direction, a user can unlock the second unit 4 relative to the first unit 3 to open the second unit 4.

In addition, the third unit 5 is able to rotate relative to the first unit 3 and the second unit 4 with the frame rotary shaft 64*a* being the center (see FIG. 3). By causing the third unit 5 to rotate relative to the first unit 3 and the second unit 4, it is possible to expose part of the original-document conveying path as illustrated in FIG. 3. In particular, it is possible to expose a reverse conveying path R3 that will be described later.

Figure 5:
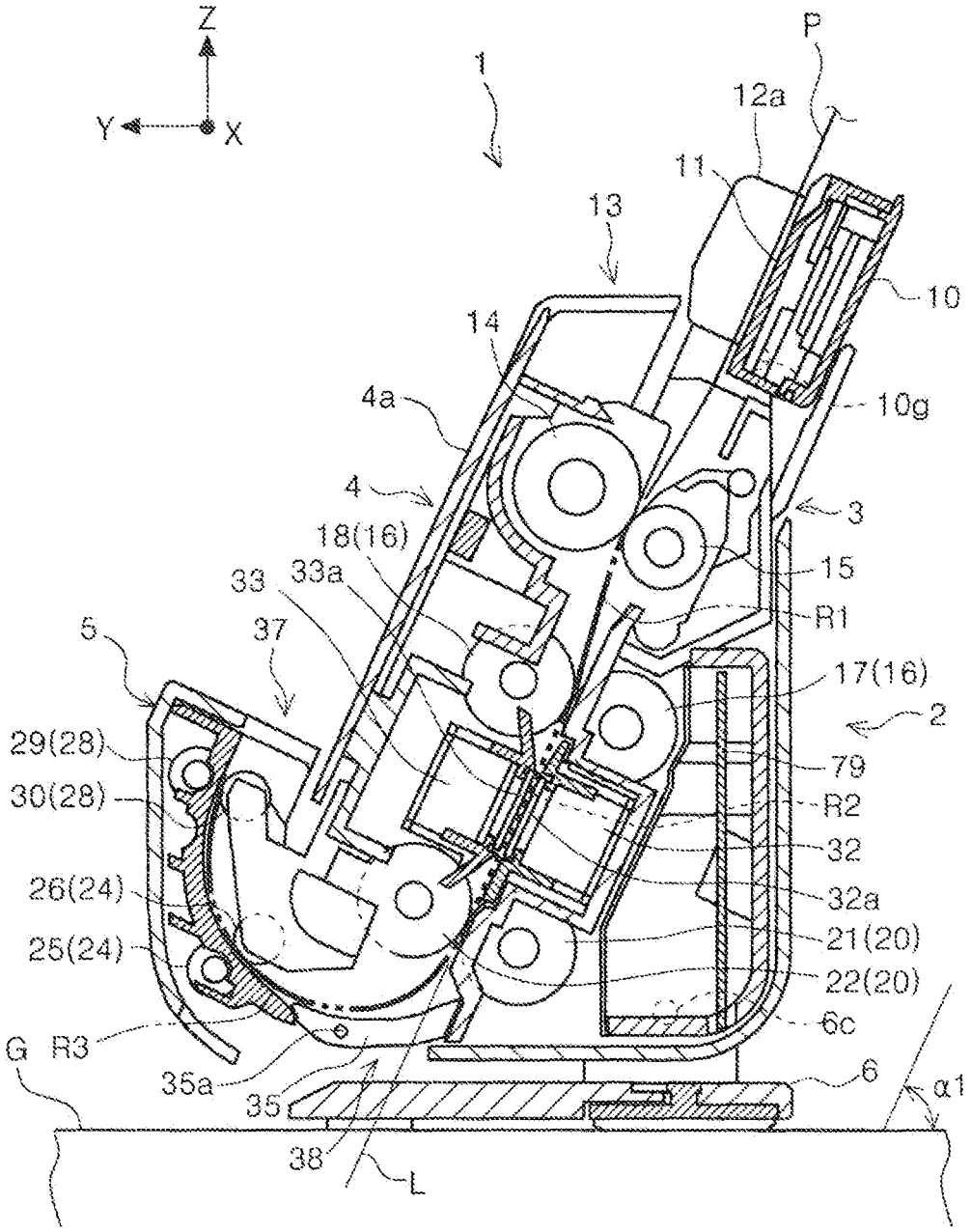
FIG. 5 is a cross-sectional view illustrating an original-document conveying path of the scanner as viewed in a width direction, the scanner including the device main body in the standard reading posture.
Figure 6:
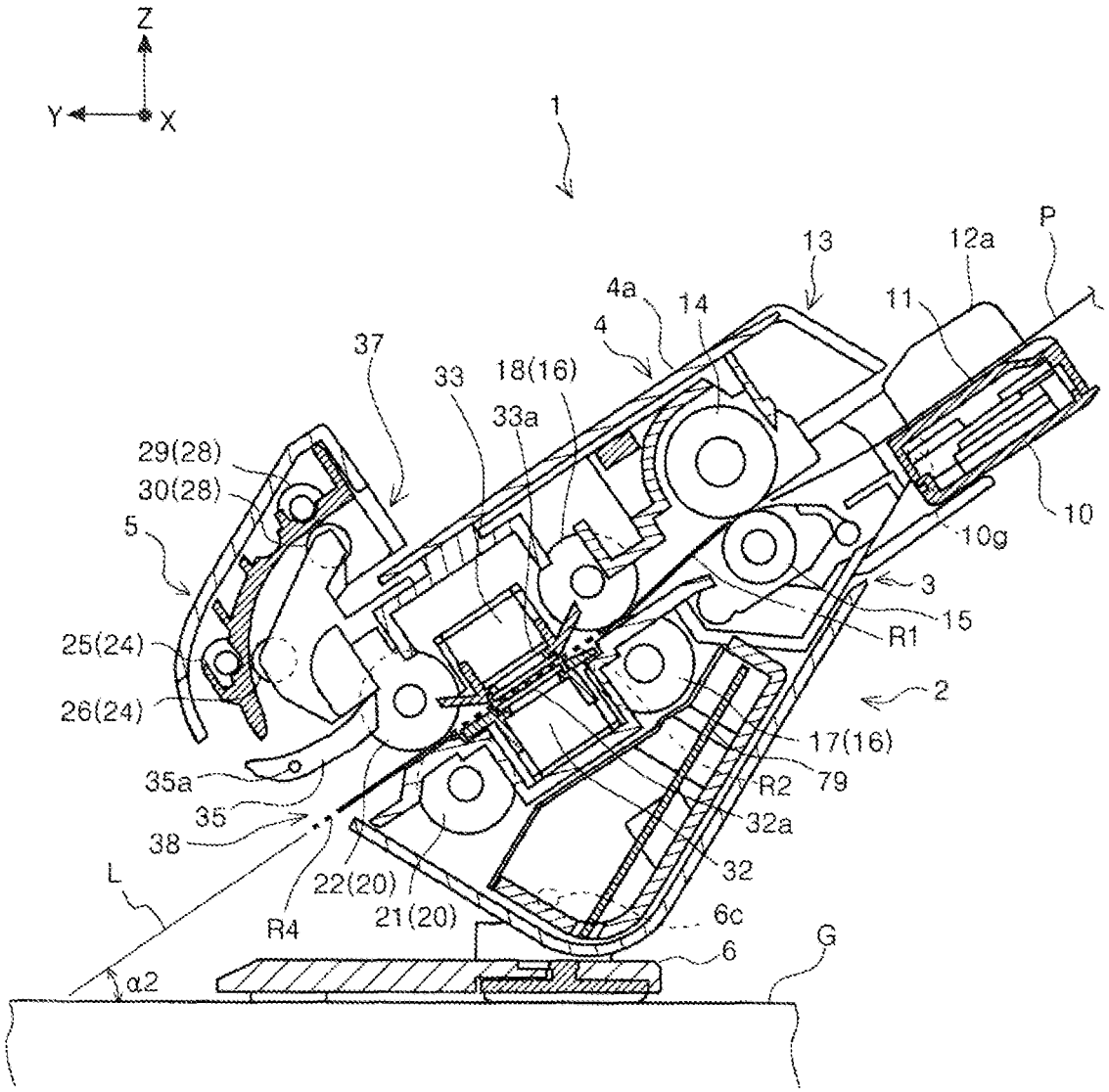
FIG. 6 is a cross-sectional view illustrating the original-document conveying path of the scanner as viewed in a width direction, the scanner including the device main body in a booklet reading posture.

The device main body 2 is able to rotate relative to the main-body support portion 6 with a main-body rotary shaft 6*c* (see FIGS. 5 and 6) being the center. In the present embodiment, the device main body 2 rotate, thereby being able to maintain two postures. The two postures of the device main body 2 are illustrated in FIGS. 5 and 6. Hereinafter, the posture in FIG. 5 is referred to as a standard reading posture, and the posture in FIG. 6 is referred to as a booklet reading posture. The standard reading posture is one example of the first posture of the device main body 2. The booklet reading posture is one example of the second posture of the device main body 2.

The angle $\alpha 1$ illustrated in FIG. 5 and the angle $\alpha 2$ illustrated in FIG. 6 are angles formed by a reading conveying path R2 and a mounting surface G for the device, each of which will be described later. The angle $\alpha 2$ in a case of the booklet reading posture is smaller than the angle $\alpha 1$ in a case of the standard reading posture.

In the standard reading posture, the projected area of the device main body 2 onto the mounting surface G where the scanner 1 is mounted is the smallest. In other words, the standard reading posture is a posture in which the footprint of the device main body 2 is the smallest.

Note that the footprint as used herein means an area that the device main body 2 takes up on the X-Y plane when the device main body 2 is viewed from above.

The standard reading posture is suitable for a sheet-shaped original document, in other words, is suitable to read an original document that has a reduced rigidity and is easily bent. The booklet reading posture is suitable to read a plastic card, a booklet or other original document that have high rigidity and is less likely to be bent.

Note that, in the present embodiment, power from a motor, which is not illustrated, is used to switch postures of the device main body 2 and maintain the posture. However, it may be possible to employ a configuration in which the posture of the device main body 2 is switched by user operations.

In FIG. 1, the front face of the device includes an operation unit 7 comprised of a plurality of operation buttons including a power button.

In addition, of side surfaces that constitute the periphery of the device, a side surface at the +X direction includes a first connection unit 71, a second connection unit 72, and a third connection unit 73, as illustrated in FIG. 2. The first connection unit 71 is a connection unit to which a plug (not illustrated) with USB Type-A is coupled. The second connection unit 72 is a connection unit to which a plug (not illustrated) with USB Type-C is coupled. The third connection unit 73 is a connection unit to which a power supply plug (not illustrated) used to supply electric power to the device main body 2 is coupled.

Note that the "USB" stands for a universal serial bus, and each of the Type-A and the Type-C is one of a plurality of types defined in the USB standard.

The first connection unit 71 is able to be coupled to an external device through a USB cable (not illustrated), and is also able to be coupled to a storage medium such as a USB memory (not illustrated). In addition, a control unit (not illustrated) of the scanner 1 is able to store read data in a storage medium coupled to the first connection unit 71.

Furthermore, an external device is able to be coupled to the second connection unit 72 through a USB cable (not illustrated).

The first connection unit 71, the second connection unit 72, and the third connection unit 73 are provided at a printed wired board (not illustrated) disposed at a back face side of the device.

Note that, in the present embodiment, the device main body 2 is configured so as to be able to receive supply of electrical power from an external device coupled to the second connection unit 72.

Next, description will be made of the configuration of the original-document conveying path in the scanner 1 with reference to FIGS. 5 and 6. The original document to be fed is supported in a sloped posture by the original-document support face 11. The reference letter "P" represents an original document that is supported. The original-document support face 11 is a face formed at an upper opening/closing section 10 serving as an original-document support portion. When a plurality of original documents are supported by the original-document support face 11, the uppermost original document is sent out downward by a feed roller 14. The upper opening/closing section 10 is able to rotate relative to the first unit 3 with the rotary shaft 10*g* (see also FIG. 7) being the center, and is configured to rotate to open and close a feed port 13. The rotary shaft 10*g* is pivotally supported by a bearing portion that is not illustrated and is formed at a first frame 63. FIG. 1 illustrates a state in which the upper opening/closing section 10 is closed. FIG. 2 illustrates a state in which the upper opening/closing section 10 is opened. The upper opening/closing section 10 constitutes the first unit 3.

In this manner, the upper opening/closing section 10 is provided so as to be able to rotate relative to the device main body 2, and rotates to switch the upper opening/closing section 10 between a state of being accommodated in the device main body 2 and a state of being able to support the original document. This makes it possible to reduce the space for installing the device when the device is not in use.

A pair of edge guides configured to guide side edges of the original document are provided at the original-document support face 11 as illustrated in FIG. 3. The pair of edge guides are comprised of a right edge guide 80 and a left edge guide 83. The right edge guide 80 and the left edge guide 83 are provided so as to be able to slide in a width direction (X-axis direction) of the original document. The right edge guide 80 and the left edge guide 83 are configured so as to be spaced apart from each other or be brought closer to each other with the center position CL (see FIG. 7) in the width direction of the original document being interposed therebetween, and are provided so as to work in a linked manner with a rack and pinion mechanism that is not illustrated. In other words, the scanner 1 employs a so-called center feed system.

With reference to FIGS. 5 and 6 again, the feed roller 14 is provided at the second unit 4. The feed roller 14 receives power from a transport motor to rotate. A separation roller 15 is provided at a position in the first unit 3 that is opposed to the feed roller 14. Rotational torque is applied to the separation roller 15 by a torque limiter that is not illustrated, to prevent multiple original documents from being fed at one time.

The feed roller 14 and the separation roller 15 are provided at the center position in the width direction of the original document (see FIG. 4).

Note that, in place of the separation roller 15, a separation pad may be provided.

Furthermore, the present embodiment is configured such that the feed roller 14 is provided at the upper side of the original document placed on the original-document support face 11 to feed original documents from the uppermost original document. However, it may be possible to employ a configuration in which the feed roller 14 is provided at the lower side of the original document placed on the original-document support face 11 to feed original documents from the lowermost original document.

A first transport roller pair 16 is provided downstream of the feed roller 14 and the separation roller 15. The first transport roller pair 16 is comprised of a first lower roller 17 provided in the first unit 3 and a first upper roller 18 provided in the second unit 4. The first upper roller 18 is provided so as to be able to advance or retreat relative to the first lower roller 17, and is pressed toward the first lower roller 17 by a not-illustrated pressing member such as a coil spring.

The first lower roller 17 and the first upper roller 18 receive power from transport motors (not illustrated), each of which will be described later, to rotate. The first lower roller 17 and the first upper roller 18 are provided such that the number of each of these rollers is two, and these two rollers are provided with the center position of the original document in the width direction being interposed between them (see FIG. 4).

When the second unit 4 is closed relative to the first unit 3, the first lower roller 17 and the first upper roller 18 are brought into contact with each other. When the second unit 4 is opened relative to the first unit 3, the first upper roller 18 is spaced apart from the first lower roller 17.

A first reading unit 32 and a second reading unit 33 are provided downstream of the first transport roller pair 16 so as to be opposed to each other. The first reading unit 32 is provided in the first unit 3. The second reading unit 33 is provided in the second unit 4. The first reading unit 32 reads a lower surface (first surface) of the original document supported by the original-document support face 11. The second reading unit 33 reads an upper surface (second surface) of the original document supported by the original-document support face 11. The second reading unit 33 is provided so as to be able to advance or retreat relative to the first reading unit 32, and is pressed toward the first reading unit 32 by a not-illustrated pressing member such as a coil spring.

In the present embodiment, the first reading unit 32 and the second reading unit 33 are comprised of a contact image sensor module (CISM). The reference character "32*a*" represents a contact glass that constitutes the first reading unit 32. The reference character "33*a*" represents a contact glass that constitutes the second reading unit 33.

A second transport roller pair 20 is provided downstream of the first reading unit 32 and the second reading unit 33. The second transport roller pair 20 is comprised of a second lower roller 21 provided in the first unit 3 and a second upper roller 22 provided in the second unit 4. The second upper roller 22 is provided so as to be able to advance or retreat relative to the second lower roller 21, and is pressed toward the second lower roller 21 by a not-illustrated pressing member such as a coil spring.

The second lower roller 21 and the second upper roller 22 receive power from transport motors (not illustrated), each of which will be described later, to rotate. The second lower roller 21 and the second upper roller 22 are provided such that the number of each of these rollers is two, and these two rollers are provided with the center position of the original document in the width direction being interposed between them (see FIG. 4).

When the second unit 4 is closed relative to the first unit 3, the second lower roller 21 and the second upper roller 22 are brought into contact with each other. When the second unit 4 is opened relative to the first unit 3, the second upper roller 22 is spaced apart from the second lower roller 21.

The long dashed short dashed line indicated by the reference character R1 in FIGS. 5 and 6 indicates the original-document feeding path. The original-document feeding path R1 extends from the nipping position of the feed roller 14 and the separation roller 15 to the nipping position of the first transport roller pair 16. In addition, the dashed line indicated by the reference character R2 in FIGS. 5 and 6 indicates the reading conveying path. The reading conveying path R2 extends from the nipping position of the first transport roller pair 16 to the nipping position of the second transport roller pair 20. The reading conveying path R2 is an original-document conveying path that is opposed to the first reading unit 32 and the second reading unit 33.

When the device main body 2 is in the standard reading posture illustrated in FIG. 5, the reverse conveying path R3 is formed downstream of the reading conveying path R2. The reverse conveying path R3 is used at the time of reversing upward the original document that has been read and discharging it. The reverse conveying path R3 is an original-document conveying path provided downstream of the nipping position of the second transport roller pair 20, and is an original-document conveying path configured to reverse, in a curved manner, the original document conveyed in the obliquely downward direction as indicated by the long dashed double-short dashed line illustrated in FIG. 5, and to discharge it from a first discharge port 37 toward the obliquely upward direction.

When the device main body 2 is in the booklet reading posture illustrated in FIG. 6, a non-reverse conveying path R4 is formed downstream of the reading conveying path R2. The non-reverse conveying path R4 is used at the time of discharging the original document that has been read, without reversing it. The non-reverse conveying path R4 is an original-document conveying path provided downstream of the nipping position of the second transport roller pair 20, and is an original-document conveying path configured such that the original document conveyed in the obliquely downward direction of the reading conveying path R2 as indicated by the long dashed double-short dashed line illustrated in FIG. 6 is discharged directly without reversing it in a curved manner, from the second discharge port 38 in the obliquely downward direction.

Note that the second transport roller pair 20 functions as a discharge roller pair configured to discharge the original document from the non-reverse conveying path R4.

The reverse conveying path R3 and the non-reverse conveying path R4 are switched by using a flap 35 that is a flap member that constitutes a unit that switches conveying paths. The flap 35 is able to rotate with a flap rotary shaft 35*a* being the center, and rotates to couple the reverse conveying path R3 to the reading conveying path R2 or couple the non-reverse conveying path R4 to the reading conveying path R2. Coupling the reverse conveying path R3 to the reading conveying path R2 means bringing the reverse conveying path R3 into a state of being usable or bringing the non-reverse conveying path R4 into a state of being not usable. Similarly, coupling the non-reverse conveying path R4 to the reading conveying path R2 means bringing the non-reverse conveying path R4 into a state of being usable or bringing the reverse conveying path R3 into a state of being not usable.

In the present embodiment, the flap 35 is configured to rotate so as to be linked with the switch of postures of the device main body 2. In the present embodiment, a solenoid, which is not illustrated, is used as a configuration of rotating the flap 35 so as to be linked with the switch of postures of the device main body 2. The control unit (not illustrated) configured to perform various types of control is configured to detect postures of the device main body 2 on the basis of a detection signal from a posture detecting sensor (not illustrated), and on the basis of the detected posture, drive the solenoid described above to cause the flap 35 to rotate. Note that the unit of causing the flap 35 to rotate is not limited to a solenoid, and it may be possible to use other actuators such as a motor or the like. Alternatively, the flap 35 may be configured so as to be linked with the posture of the device main body 2 to mechanically rotate.

A third transport roller pair 24 and a fourth transport roller pair 28 are provided at the reverse conveying path R3.

The third transport roller pair 24 is comprised of a third driving roller 25 provided in the third unit 5, and a third driven roller 26 provided in the second unit 4. The third driven roller 26 is provided so as to be able to advance or retreat relative to the third driving roller 25, and is pressed toward the third driving roller 25 by a not-illustrated pressing member such as a coil spring. The third driving roller 25 is driven by a transport motor (not illustrated). The third driven roller 26 is a roller that rotates in a driven manner.

The fourth transport roller pair 28 is comprised of a fourth driving roller 29 provided in the third unit 5, and a fourth driven roller 30 provided in the second unit 4. The fourth driven roller 30 is provided so as to be able to advance or retreat relative to the fourth driving roller 29, and is pressed toward the fourth driving roller 29 by a not-illustrated pressing member such as a coil spring. The fourth driving roller 29 is driven by a transport motor (not illustrated). The fourth driven roller 30 is a roller that rotates in a driven manner.

The third driving roller 25, the third driven roller 26, the fourth driving roller 29, and the fourth driven roller 30 are provided such that the number of each of these rollers is two, and these two rollers are provided with the center position of the original document in the width direction being interposed between them (FIG. 3).

When the third unit 5 is closed relative to the second unit 4, the third driving roller 25 and the third driven roller 26 are brought into contact with each other and the fourth driving roller 29 and the fourth driven roller 30 are also brought into contact with each other. When the third unit 5 is opened relative to the second unit 4, the third driving roller 25 and the third driven roller 26 are spaced apart from each other and the fourth driving roller 29 and the fourth driven roller 30 are also spaced apart from each other.

The original document that is conveyed through the reverse conveying path R3 is discharged by the fourth transport roller pair 28 obliquely upward including a component of the −Y direction, and is supported in a sloped posture by an upper surface 4*a* of the second unit 4.

Note that, in the present embodiment, the device main body 2 rotates by the power from a posture switching motor (not illustrated) under control of the control unit (not illustrated), and switches postures. The control unit (not illustrated) switches postures of the device main body 2 on the basis of an original-document reading instruction provided from an external device (not illustrated) such as a computer, by way of example. The external device is able to set types of the original document to be read. When the original document to be read is a card-like original document or a booklet-shaped original document, the posture of the device main body 2 is set to be the booklet reading posture. When the original document to be read is a sheet-like original document, the posture of the device main body 2 is set to be the standard reading posture.

Next, description will be made of an expansion support portion provided at the upper opening/closing section 10. In FIGS. 7 to 10, the upper opening/closing section 10 includes a right-side expansion support portion 40 and a left-side expansion support portion 50. Note that the right-side expansion support portion 40 and the left-side expansion support portion 50 are axial symmetric with respect to the center position (center line) CL in the width direction, and have the same basic structure. Hereinafter, when no distinction is made between the right-side expansion support portion 40 and the left-side expansion support portion 50, they may be simply referred to as an "expansion support portion" without attaching any reference character.

Figure 7:
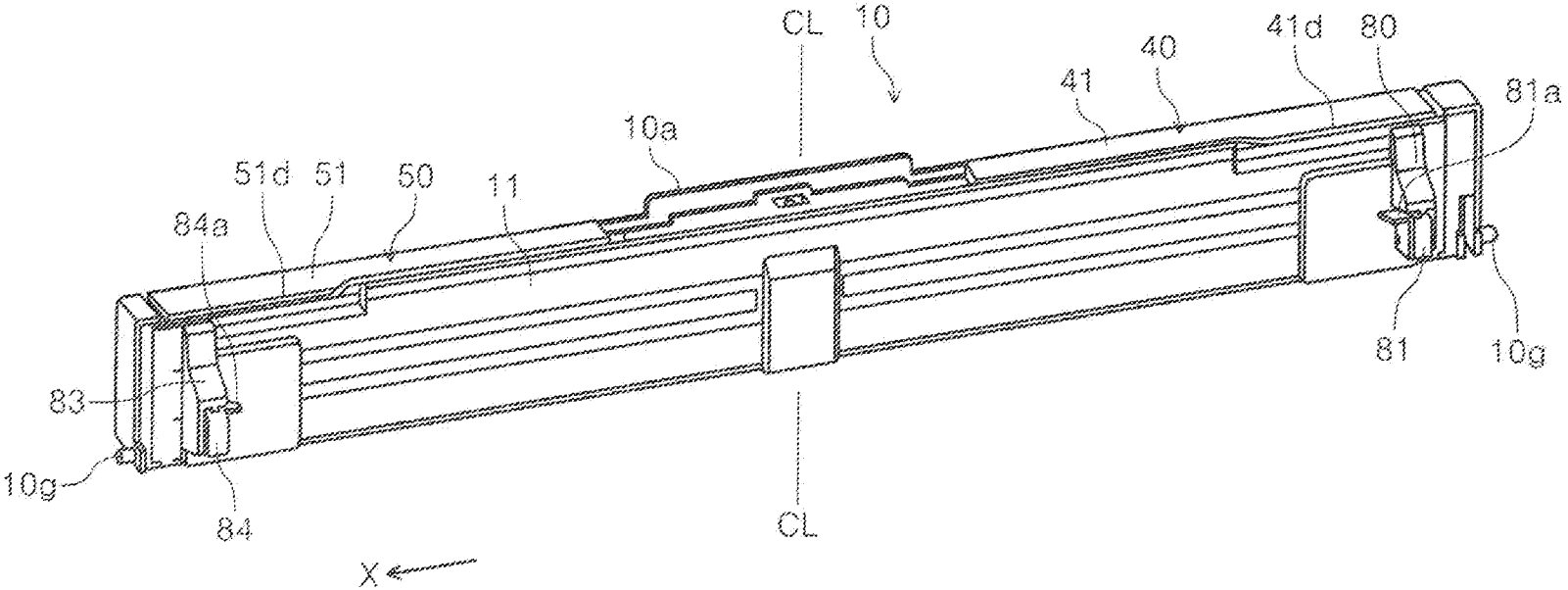
FIG. 7 is a perspective view illustrating an upper opening/closing section.
Figure 10:
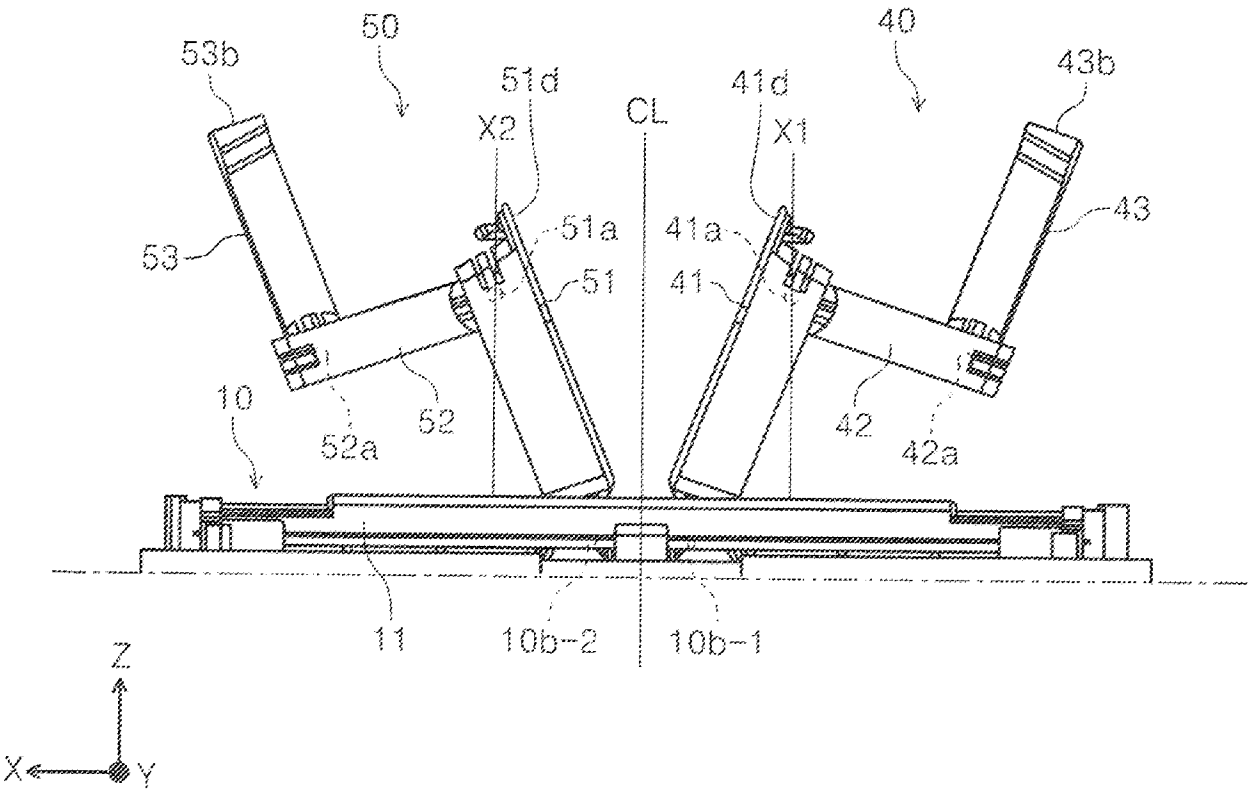
FIG. 10 is a front view illustrating the expansion support portion in the middle of expansion.
Figure 11:
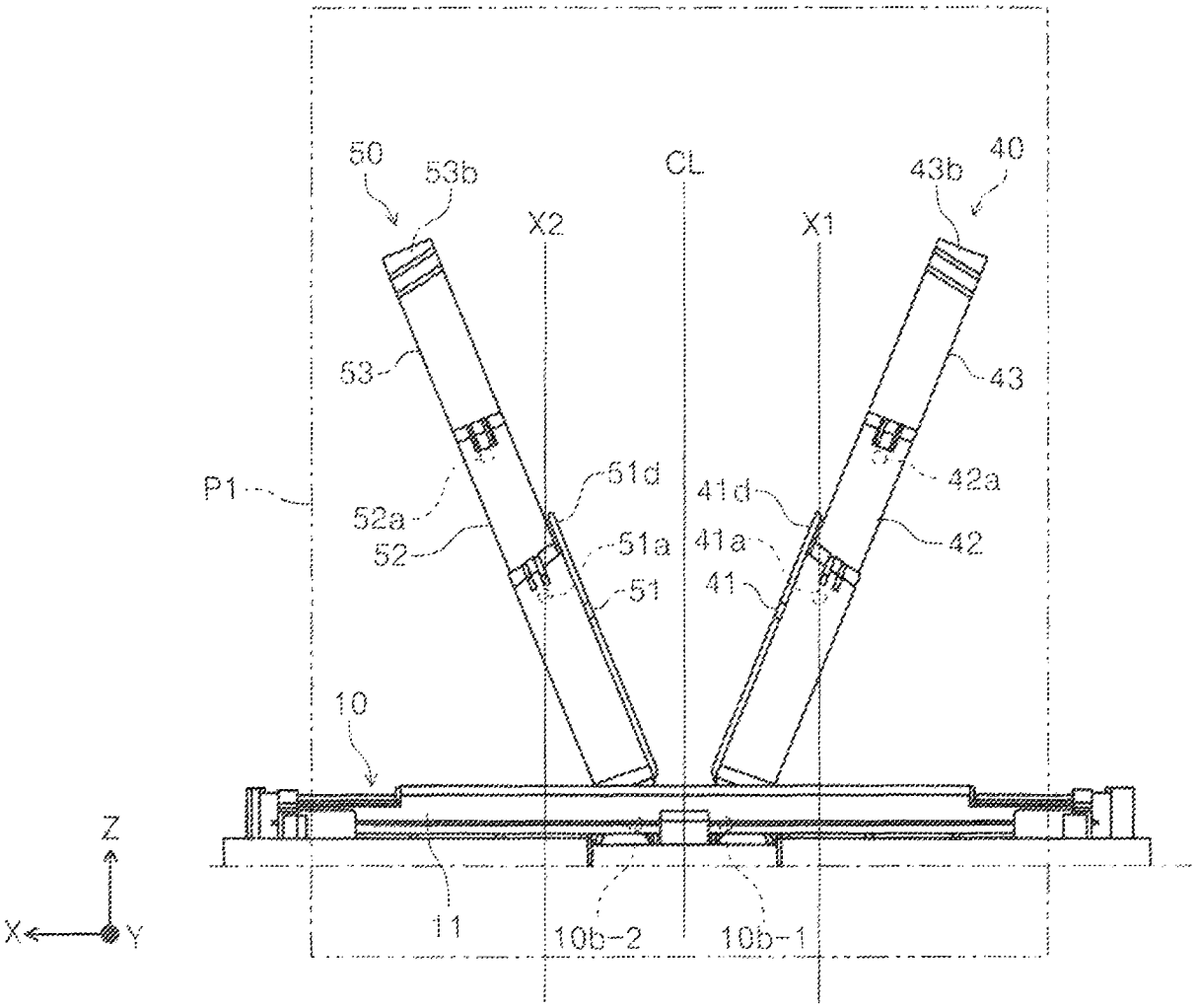
FIG. 11 is a front view illustrating the expansion support portion in the middle of expansion.
Figure 13:
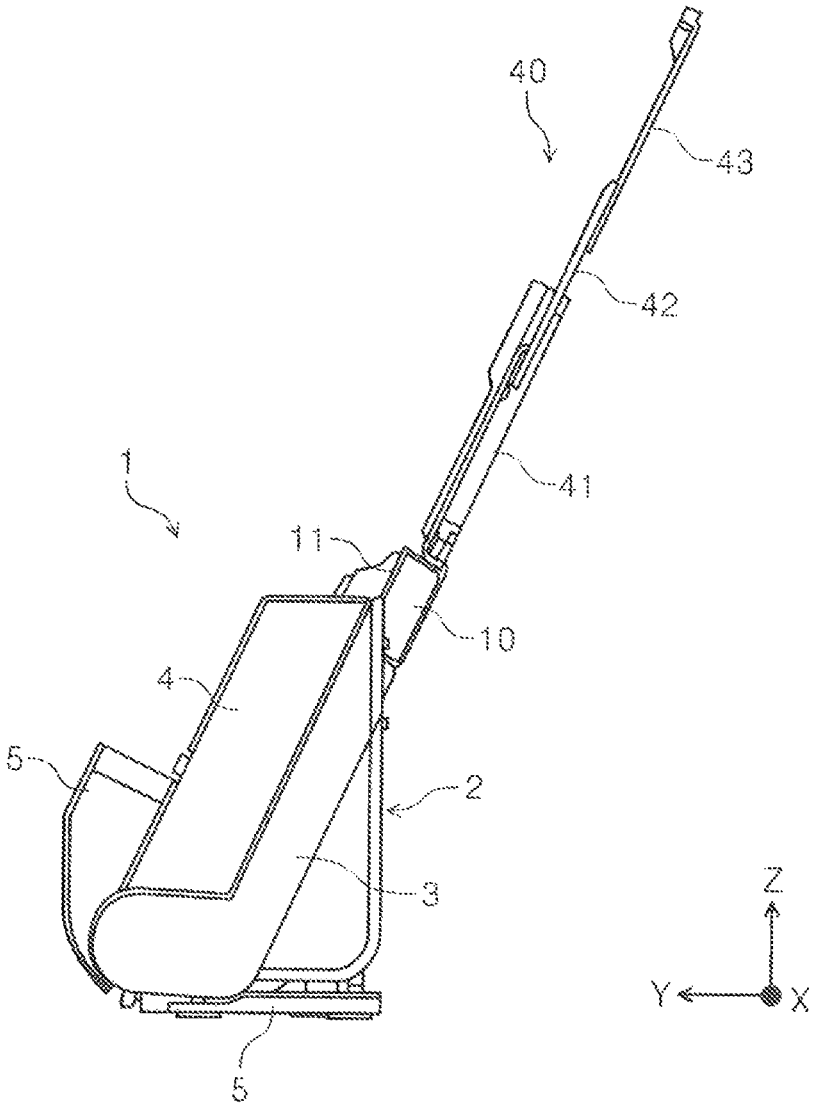
FIG. 13 is a side view illustrating the scanner including the expansion support portion in an expanded state and the device main body in the standard reading posture.

In addition, in a state illustrated in FIG. 7, the expansion support portion is set to be in an accommodated state, whereas, in a state illustrated in FIGS. 11 and 13, the expansion support portion is set to be in an expanded state. In a state illustrated in FIGS. 8, 9, and 10, the expansion support portion is in a half-expanded state.

Each of the expansion support portions is able to be accommodated in and expanded from the upper opening/closing section 10 serving as the original-document support portion. With the expansion support portion being expanded from the upper opening/closing section 10, the expansion support portion supports the original document that has been fed, together with the original-document support face 11 of the upper opening/closing section 10.

The right-side expansion support portion 40 includes a first expansion portion 41 that is an expansion portion configured to rotate relative to the upper opening/closing section 10, thereby being able to be expanded and accommodated. In a state of being accommodated in the upper opening/closing section 10, the first expansion portion 41 extends along the X-axis direction, that is, along the width direction that is a direction intersecting the original-document feeding direction. Furthermore, the right-side expansion support portion 40 includes a second expansion portion 42 that is an expansion portion configured to be able to be accommodated in and expanded from the first expansion portion 41. The second expansion portion 42 extends along the X-axis direction in a state in which the right-side expansion support portion 40 is accommodated.

Note that, in the present embodiment, the right-side expansion support portion 40 includes a third expansion portion 43 that is an expansion portion configured to be able to be accommodated in and expanded from the second expansion portion 42. The third expansion portion 43 extends along the X-axis direction in a state in which the right-side expansion support portion 40 is accommodated.

The left-side expansion support portion 50 also has a configuration similar to that of the right-side expansion support portion 40. In other words, the left-side expansion support portion 50 includes a first expansion portion 51 that is an expansion portion configured to rotate relative to the upper opening/closing section 10, thereby being expanded and accommodated. The first expansion portion 51 extends along the X-axis direction, that is, along the width direction that is a direction intersecting the original-document feeding direction in a state of being accommodated in the upper opening/closing section 10. In addition, the left-side expansion support portion 50 includes a second expansion portion 52 that is an expansion portion configured to be accommodated in and expanded from the first expansion portion 51. The second expansion portion 52 extends along the X-axis direction in a state in which the left-side expansion support portion 50 is accommodated.

Note that, in the present embodiment, the left-side expansion support portion 50 includes a third expansion portion 53 that is an expansion portion configured to be able to be accommodated in and expanded from the second expansion portion 52. The third expansion portion 53 extends along the X-axis direction in a state in which the left-side expansion support portion 50 is accommodated.

Hereinafter, when no distinction is made between the first expansion portion 41 included in the right-side expansion support portion 40 and the first expansion portion 51 included in the left-side expansion support portion 50, they may be simply referred to as a "first expansion portion" without attaching any reference character. Similarly, when no distinction is made between the second expansion portion 42 included in the right-side expansion support portion 40 and the second expansion portion 52 included in the left-side expansion support portion 50, they may be simply referred to as a "second expansion portion" without attaching any reference character. Furthermore, similarly, when no distinction is made between the third expansion portion 43 included in the right-side expansion support portion 40 and the third expansion portion 53 included in the left-side expansion support portion 50, they may be simply referred to as a "third expansion portion" without attaching any reference character.

Figure 15:
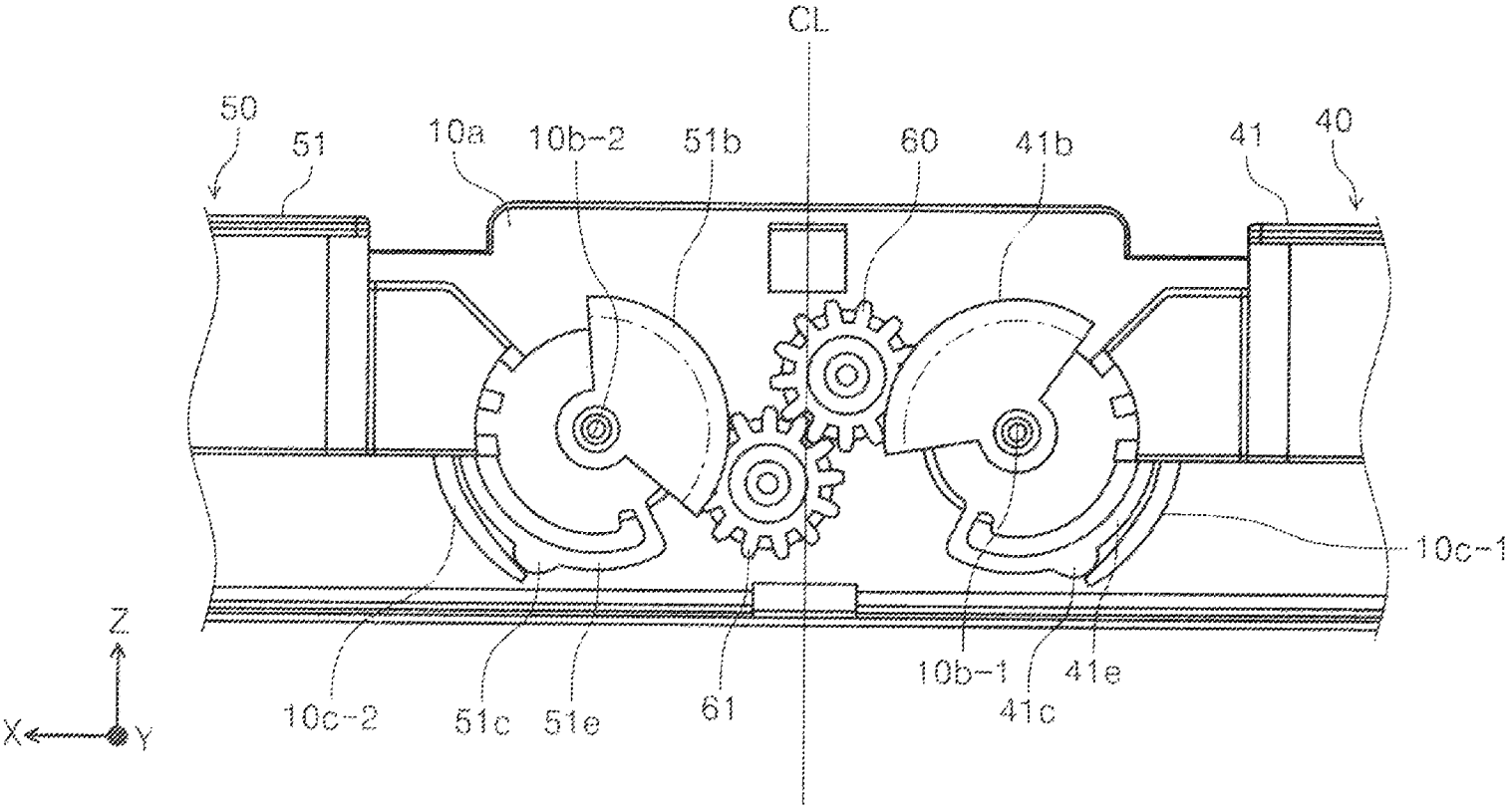
FIG. 15 is a plan view illustrating a mechanism used to cause a right-side expansion support portion and a left-side expansion support portion to work in a linked manner.

In addition, in a state illustrated in FIGS. 7 and 15, the first expansion portion is set to be in an accommodated state, whereas, in a state illustrated in FIGS. 8 to 12, 16, and 17, the first expansion portion is set to be in an expanded state.

Figure 8:
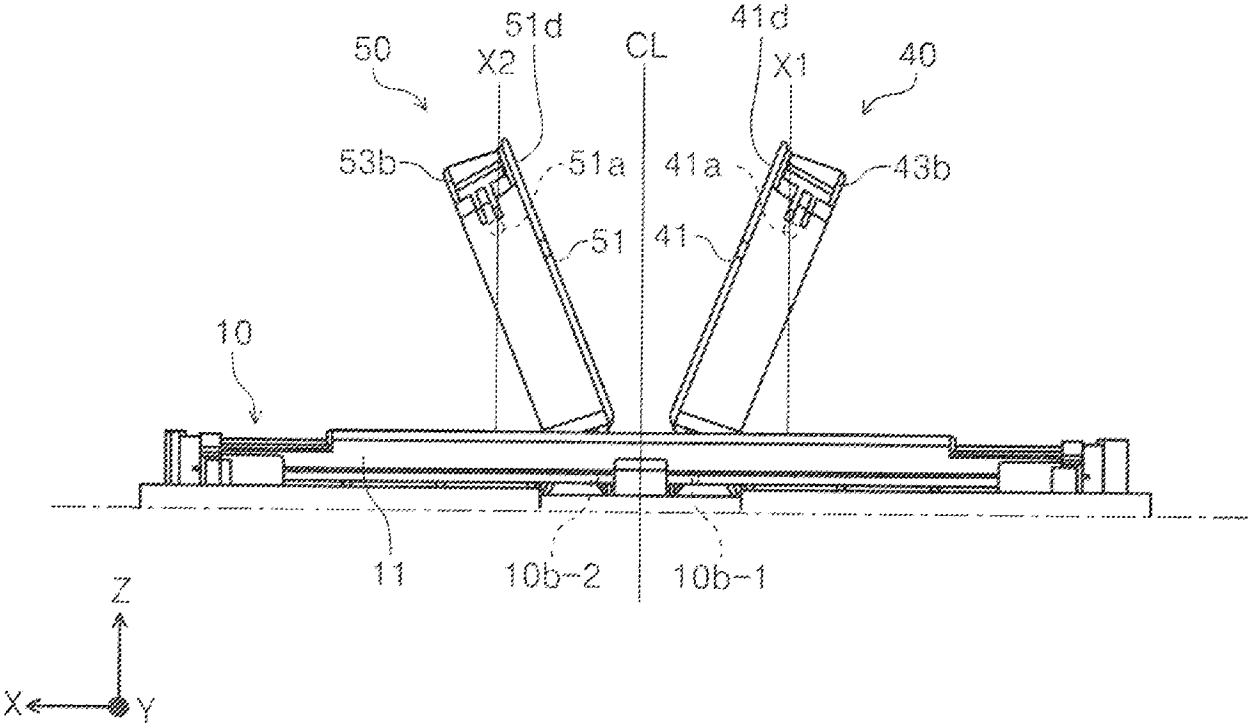
FIG. 8 is a front view illustrating an expansion support portion in the middle of expansion.

Furthermore, in a state illustrated in FIGS. 7 and 8, the second expansion portion is set to be in an accommodated state. In a state illustrated in FIGS. 9 and 10, the second expansion portion is set to be in a half-expanded state. In a state illustrated in FIG. 11, the second expansion portion is set to be in an expanded state.

In addition, in a state illustrated in FIGS. 7 and 8, the third expansion portion is set to be in an accommodated state. In a state illustrated in FIGS. 9 and 10, the third expansion portion is set to be in a half-expanded state. In a state illustrated in FIG. 11, the third expansion portion is set to be in an expanded state.

In the present embodiment, the length of the first expansion portion in the longitudinal direction is longer than the length of the second expansion portion in the longitudinal direction. In addition, the length of the third expansion portion in the longitudinal direction is longer than the length of the second expansion portion in the longitudinal direction.

In this manner, the expansion support portion includes the first expansion portion and the second expansion portion, each of which is an expansion portion configured to rotate relative to the upper opening/closing section 10, thereby being able to be expanded and accommodated. These expansion portions extend along the X-axis direction in a state of being accommodated in the upper opening/closing section 10. Thus, even when the device cannot have a sufficient dimension in the original-document feeding direction due to the reduction in the size of the device, the dimension in the X-axis direction, that is, the dimension in the width direction that is a direction intersecting the original-document feeding direction is utilized. This enables the first expansion portion and the second expansion portion to have sufficient sizes in the original-document feeding direction at the time of being expanded. Thus, it is possible to appropriately support the original document while reducing the size of the device.

Below, further detailed description will be made. The first expansion portion 41 is provided so as to be able to rotate relative to a rotary shaft 10*b*-1 (see also FIGS. 15 to 17) formed at a frame 10*a* that constitutes the base of the upper opening/closing section 10. The center line of the rotary shaft of the first expansion portion 41 is perpendicular to the original-document support face 11.

In addition, the first expansion portion 51 is provided so as to be able to rotate relative to a rotary shaft 10*b*-2 (see also FIGS. 15 to 17) formed at the frame 10*a*. The center line of the rotary shaft of the first expansion portion 51 is perpendicular to the original-document support face 11.

The rotary shafts 10*b*-1 and 10*b*-2 are provided near the center position CL in the X-axis direction.

A handle portion 41*d* is formed at the first expansion portion 41 that constitutes the right-side expansion support portion 40. The handle portion 41*d* protrudes toward the front side of the device from the original-document support face 11 in a state in which the right-side expansion support portion 40 is accommodated as illustrated in FIG. 7. By holding this handle portion 41*d*, a user can pull out the accommodated right-side expansion support portion 40 in the upward direction as illustrated by the transition from FIG. 7 to FIG. 8.

Similarly, a handle portion 51*d* is formed at the first expansion portion 51 that constitutes the left-side expansion support portion 50. The handle portion 51*d* protrudes toward the front side of the device from the original-document support face 11 in a state in which the left-side expansion support portion 50 is accommodated as illustrated in FIG. 7. By holding this handle portion 51*d*, a user can pull out the accommodated left-side expansion support portion 50 in the upward direction as illustrated by the transition from FIG. 7 to FIG. 8.

Figure 16:
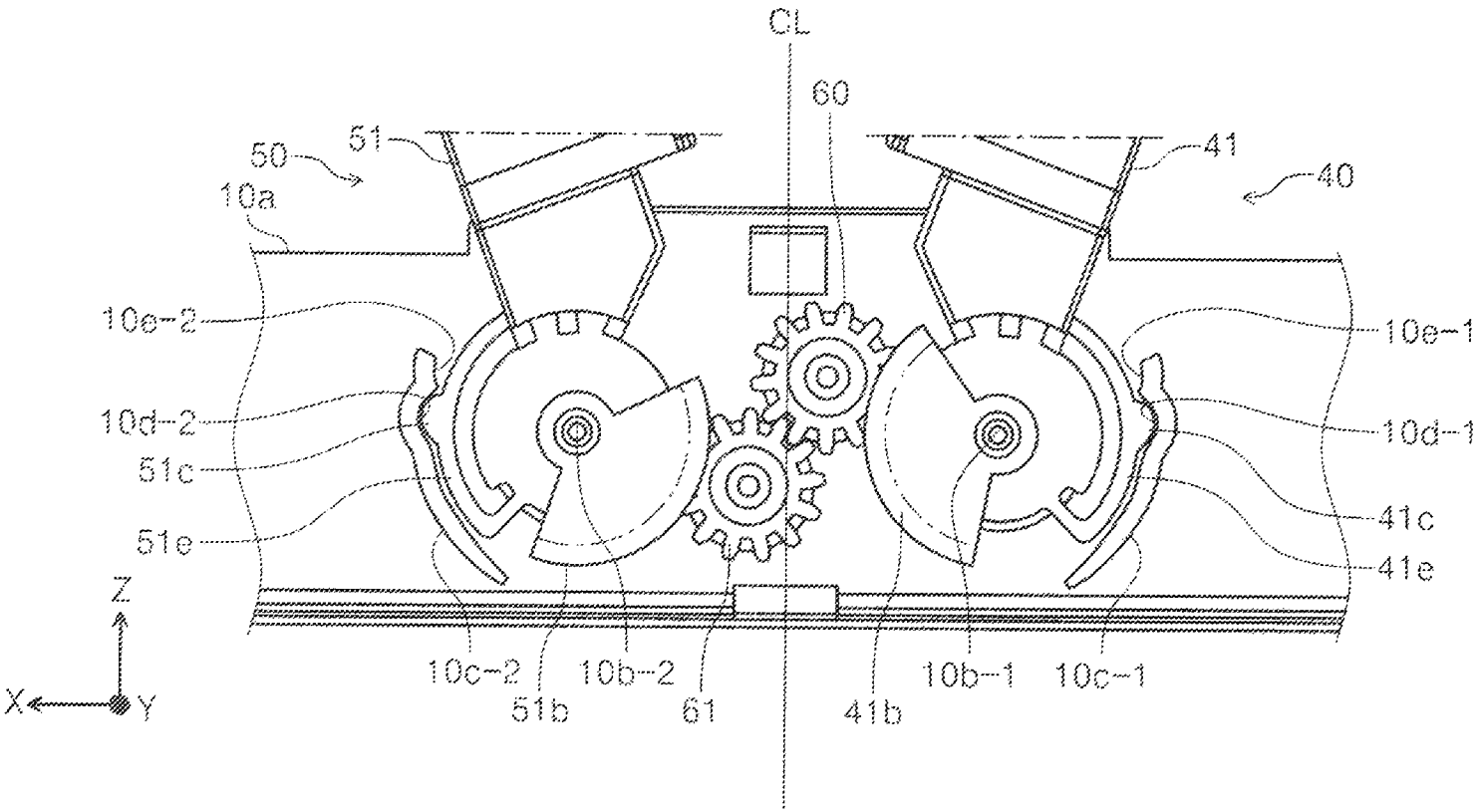
FIG. 16 is a plan view illustrating a mechanism used to cause the right-side expansion support portion and the left-side expansion support portion to work in a linked manner.
Figure 17:
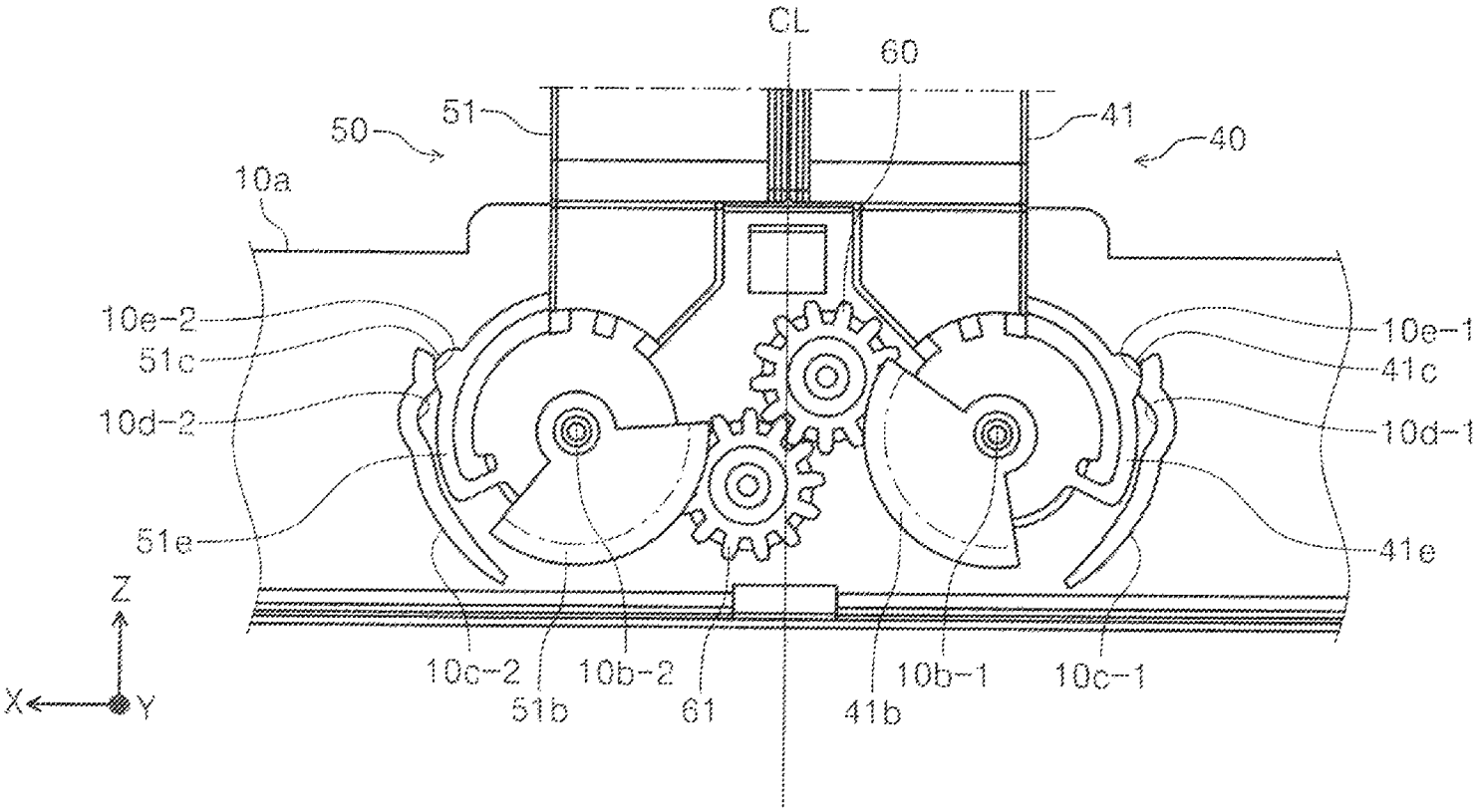
FIG. 17 is a plan view illustrating a mechanism used to cause the right-side expansion support portion and the left-side expansion support portion to work in a linked manner.

As illustrated in FIGS. 15 to 17, at the base end side of the first expansion portion 41, teeth 41*b* are formed around the axial center of the rotary shaft 10*b*-1. In addition, at the base end side of the first expansion portion 51, teeth 51*b* are formed around the axial center of the rotary shaft 10*b*-2.

Toothed gears 60 and 61 are rotatably supported at the frame 10*a* in a state of meshing with each other. The teeth 41*b* mesh with the toothed gear 60, and the teeth 51*b* mesh with the toothed gear 61. With this configuration, the right-side expansion support portion 40 and the left-side expansion support portion 50 rotate in a linked manner. For example, by holding the right-side expansion support portion 40 to pull it out upward, the left-side expansion support portion 50 is also pulled out upward in conjunction with this.

In addition, a holding unit 10*c*-1 is formed at the frame 10*a* and around the axial center of the rotary shaft 10*b*-1. Furthermore, a holding unit 10*c*-2 is formed at the frame 10*a* and around the axial center of the rotary shaft 10*b*-2.

An elastically deforming portion 41*e* is formed at the first expansion portion 41 and around the axial center of the rotary shaft 10*b*-1. A protrusion 41*c* is formed at the elastically deforming portion 41*e*. The elastically deforming portion 41*e* is able to elastically deform in the radial direction. This allows for displacement of the protrusion 41*c* in the radial direction.

Similarly, an elastically deforming portion 51*e* is formed at the first expansion portion 51 and around the axial center of the rotary shaft 10*b*-2. A protrusion 51*c* is formed at the elastically deforming portion 51*e*. The elastically deforming portion 51*e* is able to elastically deform in the radial direction. This allows for displacement of the protrusion 51*c* in the radial direction.

FIG. 15 illustrates a state in which the expansion support portion is accommodated. In this state, the protrusion 41*c* is disposed so as to get slightly caught on the lower end portion of the holding unit 10*c*-1, and the protrusion 51*c* is disposed so as to get slightly caught on the lower end portion of the holding unit 10*c*-2. This maintains the state in which the first expansion portion is accommodated. Note that an elastic protrusion that is not illustrated is formed at the first expansion portion. This elastic protrusion enters a recessed portion (not illustrated) formed in the frame 10*a*, thereby maintaining the state in which the first expansion portion is accommodated.

FIG. 16 illustrates that the expansion support portion is in the half-expanded state, and corresponds to the state of the first expansion portion illustrated in FIGS. 8 to 11. This state is a state in which the first expansion portion rotates by approximately 65° to 70° from the state in which the first expansion portion is accommodated. In this state, the protrusion 41*c* enters a first recessed portion 10*d*-1 formed at the holding unit 10*c*-1 while elastically deforming, and the protrusion 51*c* enters the first recessed portion 10*d*-2 formed at the holding unit 10*c*-2 while elastically deforming. This maintains the expanded state of the first expansion portion.

Figure 12:
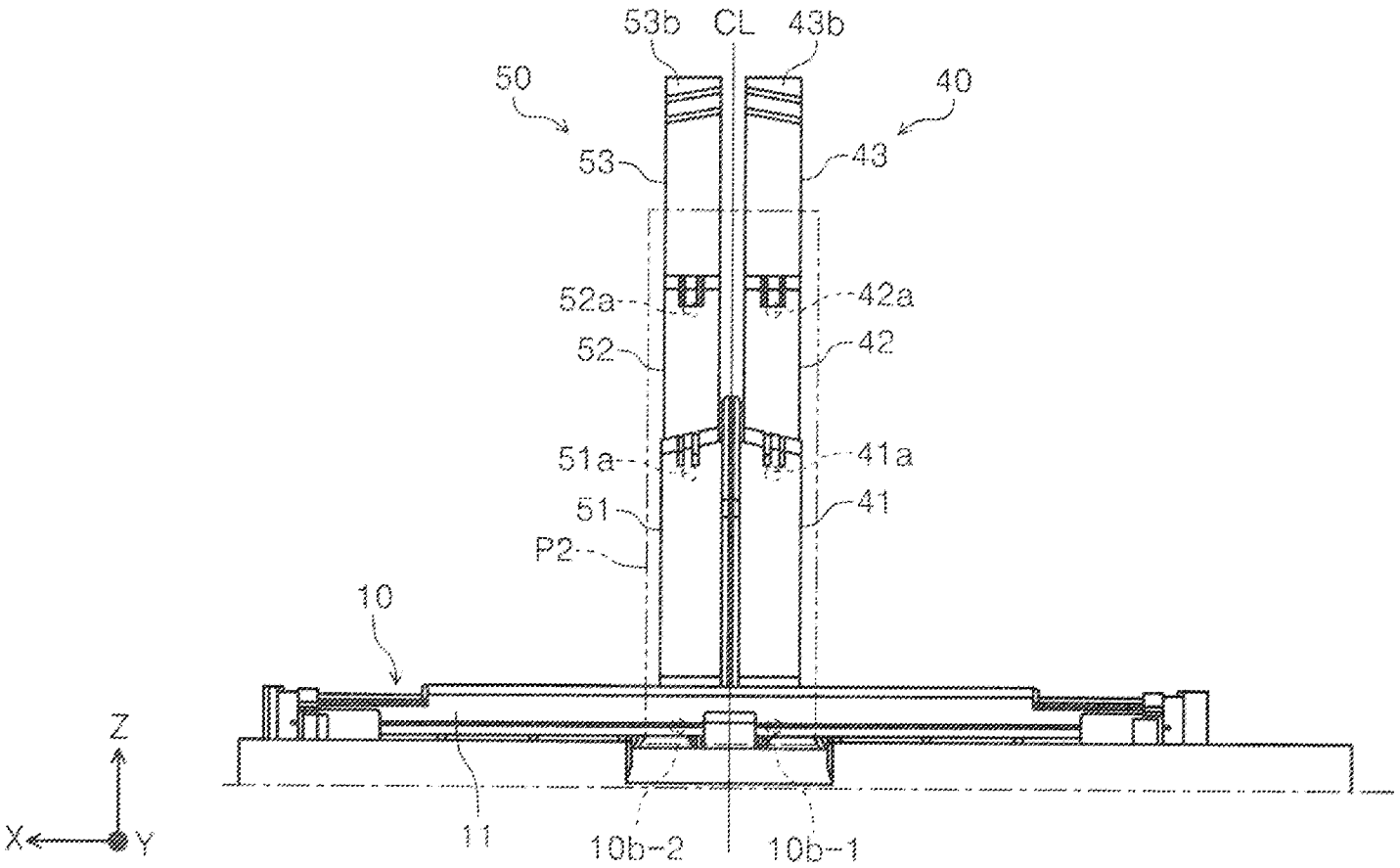
FIG. 12 is a front view illustrating the expansion support portion in the middle of expansion.

In addition, in the present embodiment, the first expansion portion can take two expanded states. FIGS. 12 and 17 illustrate the second expanded state of the first expansion portion, and illustrate a state in which the first expansion portion rotates by approximately 90° from the accommodated state. In this state, the protrusion 41*c* enters a second recessed portion 10*e*-1 formed in the holding unit 10*c*-1 as illustrated in FIG. 17 while elastically deforming, and the protrusion 51*c* enters a second recessed portion 10*e*-2 formed in the holding unit 10*c*-2 while elastically deforming. This maintains the second expanded state of the first expansion portion.

Figure 9:
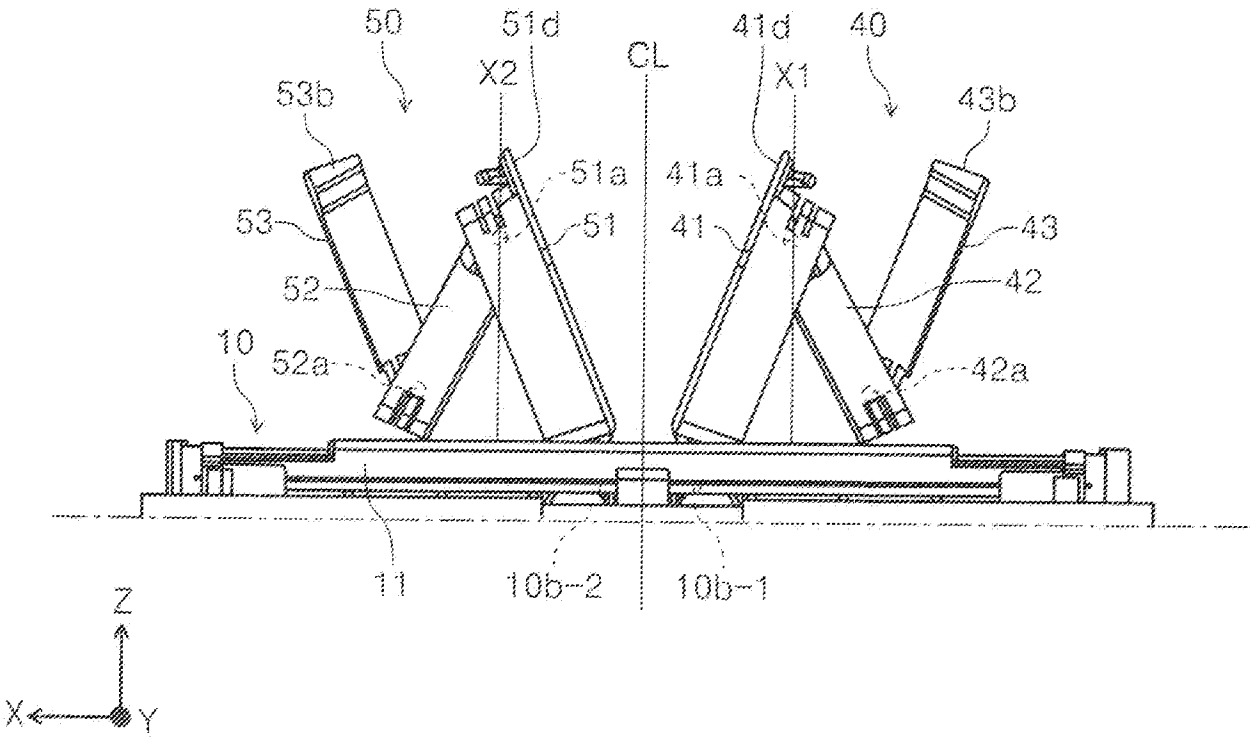
FIG. 9 is a front view illustrating the expansion support portion in the middle of expansion.

Next, as illustrated in FIG. 9, a rotary shaft 41*a* is provided at a free end side of the first expansion portion 41, and the second expansion portion 42 is rotatable with the rotary shaft 41*a* being the center. In addition, a rotary shaft 42*a* is provided at a side of the second expansion portion 42 that is opposite from the side where the rotary shaft 41*a* is provided, and the third expansion portion 43 is rotatable with the rotary shaft 42*a* being the center. Note that the center line of the rotary shaft of the first expansion portion 41, the center line of the rotary shaft of the second expansion portion 42, and the center line of the rotary shaft of the third expansion portion 43 are all in parallel.

Similarly, a rotary shaft 51*a* is provided at a free end side of the first expansion portion 51, and the second expansion portion 52 is rotatable with the rotary shaft 51*a* being the center. In addition, a rotary shaft 52*a* is provided at a side of the second expansion portion 52 that is opposite from the side where the rotary shaft 51*a* is provided, and the third expansion portion 53 is rotatable with the rotary shaft 52*a* being the center. Note that the center line of the rotary shaft of the first expansion portion 51, the center line of the rotary shaft of the second expansion portion 52, and the center line of the rotary shaft of the third expansion portion 53 are all in parallel.

In a state in which the expansion support portion is accommodated, the rotary shaft 41*a* is disposed more toward the −X direction than the rotary shaft 10*b*-1. In addition, in a state in which the expansion support portion is accommodated, the rotary shaft 51*a* is disposed more toward the +X direction than the rotary shaft 10*b*-2.

Description will be made of a procedure of switching the expansion support portion configured as described above, from the accommodated state to the expanded state.

From the accommodated state illustrated in FIG. 7, by pulling upward the handle portion 41*d* of the right-side expansion support portion 40 or the handle portion 51*d* of the left-side expansion support portion 50 as described above to bring the first expansion portion into the expanded state as illustrated in FIG. 8, the handle portion 43*b* provided at the free end of the third expansion portion 43 is exposed, and the handle portion 53*b* provided at the free end of the third expansion portion 53 is exposed.

From this state, for example, by pulling out the handle portion 43*b* of the right-side expansion support portion 40 toward the −X direction, that is, toward a direction away from the left-side expansion support portion 50, the second expansion portion 42 is exposed from the first expansion portion 41 in the −X direction, and the third expansion portion 43 is exposed from the second expansion portion 42 in the −X direction, as illustrated by the transition from FIG. 8 to FIG. 9.

Similarly, by pulling out the handle portion 53*b* of the left-side expansion support portion 50 toward the +X direction, that is, toward a direction away from the right-side expansion support portion 40, the second expansion portion 52 is exposed from the first expansion portion 51 in the +X direction, and the third expansion portion 53 is exposed from the second expansion portion 52 in the +X direction, as illustrated by the transition from FIG. 8 to FIG. 9.

Furthermore, from the state in FIG. 9, by pulling the handle portion 43*b* of the right-side expansion support portion 40 toward the +Z direction, that is, pulling it upward, it is possible to expand the second expansion portion 42 and the third expansion portion 43, as illustrated by the transition through the state in FIG. 10 to the state in FIG. 11. Then, the first expansion portion 41, the second expansion portion 42, and the third expansion portion 43 are brought into a state in which they straightly extend in the right upward direction, that is, the right-side expansion support portion 40 is brought into the expanded state. Similarly, from the state in FIG. 9, by pulling the handle portion 53*b* of the left-side expansion support portion 50 toward the +Z direction, that is, pulling it upward, it is possible to expand the second expansion portion 52 and the third expansion portion 53, as illustrated by the transition through the state in FIG. 10 to the state in FIG. 11. Then, the first expansion portion 51, the second expansion portion 52, and the third expansion portion 53 are brought into a state in which they straightly extend in the left upward direction, that is, the left-side expansion support portion 50 is brought into the expanded state.

In the expanded state, the expansion support portion straightly extends toward the obliquely upward so as to be parallel to the original-document support face 11 as viewed from the width direction as illustrated in FIG. 13.

Note that there are provided a maintaining unit configured to maintain the state in which the second expansion portion is expanded relative to the first expansion portion, and a maintaining unit configured to maintain the state in which the third expansion portion is expanded relative to the second expansion portion. These maintaining units have the same basic configuration, and one example thereof is illustrated in FIG. 14.

Figure 14A:
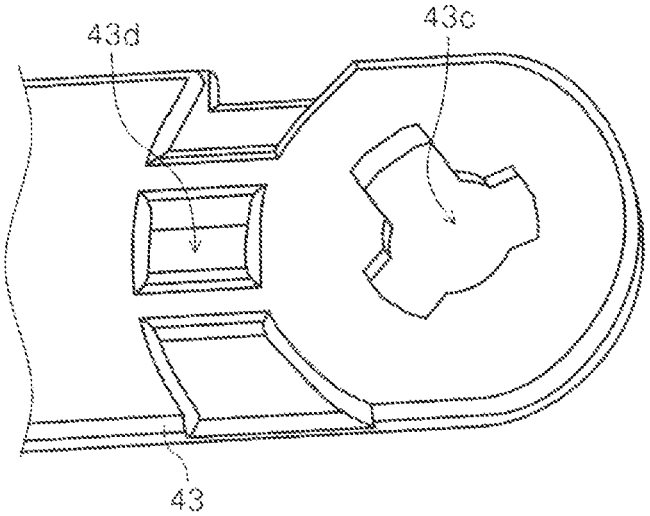
FIG. 14A is a partial perspective view illustrating a third expansion portion.
Figure 14B:
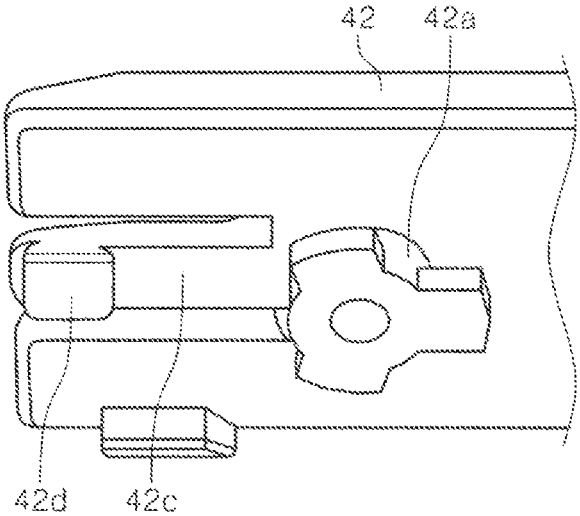
FIG. 14B is a partial perspective view illustrating a second expansion portion.

FIG. 14 illustrates a maintaining unit configured to maintain the state in which the third expansion portion 43 is expanded relative to the second expansion portion 42. As illustrated in FIG. 14A, a hole 43*c* is formed in the third expansion portion 43. The rotary shaft 42*a* is formed at the second expansion portion 42. With the rotary shaft 42*a* being fitted into the hole 43*c*, the third expansion portion 43 is rotatable relative to the second expansion portion 42.

An elastic piece 42*c* is formed at the second expansion portion 42, and a protruding portion 42*d* is formed at the elastic piece 42*c*. A recessed portion 43*d* is formed at the third expansion portion 43. In a state in which the third expansion portion 43 is expanded relative to the second expansion portion 42, the protruding portion 42*d* enters the recessed portion 43*d* to maintain the state in which the third expansion portion 43 is expanded relative to the second expansion portion 42.

The left-side expansion support portion 50 also has a configuration similar to the configuration described above. In addition, an elastic piece and a protruding portion similar to the elastic piece 42*c* and the protruding portion 42*d* described above are also formed at the first expansion portion. Furthermore, a recessed portion similar to the recessed portion 43*d* described above is also formed in the second expansion portion.

In the manner described above, the expansion support portion not only includes the second expansion portion configured to be able to be accommodated in and expanded from the first expansion portion but also includes the third expansion portion that is an expansion portion configured to be able to be accommodated in and expanded from the second expansion portion and also extend along the width direction in a state in which the expansion support portion is accommodated. This makes it possible to further sufficiently obtain the size of the expansion support portion in the original-document feeding direction.

In addition, the second expansion portion rotates relative to the first expansion portion to be able to be expanded from and accommodated in the first expansion portion. Furthermore, the third expansion portion rotates relative to the second expansion portion to be able to be expanded from and accommodated in the second expansion portion. Thus, the following operation and effect can be obtained.

For example, in a case of a configuration in which the second expansion portion slides relative to the first expansion portion to be expanded from and accommodated in the first expansion portion, the first expansion portion needs to maintain the second expansion portion in a slidable manner. This results in an increase in the width of the first expansion portion to be wider than the second expansion portion. In other words, the width of the second expansion portion is narrower than the width of the first expansion portion. This similarly applies to the relationship between the third expansion portion and the second expansion portion. Thus, when both the second expansion portion and the third expansion portion are of a slide type, the width of the expansion support portion reduces from the base end toward the free end. This results in a configuration in which the area for supporting the original document reduces, which is not preferable.

However, the present aspect employs a configuration in which the second expansion portion and the third expansion portion also rotate to be accommodated and expanded, in addition to the first expansion portion. This makes it possible to sufficiently obtain the widths of the second expansion portion and the third expansion portion, which makes it possible to appropriately support the original document.

In addition, the scanner 1 includes the right-side expansion support portion 40 and the left-side expansion support portion 50 so as to interpose, between them, the center position CL of the upper opening/closing section 10 in the X-axis direction, that is, the feed reference position. Furthermore, the right-side expansion support portion 40 extends right upward toward the upstream of the original-document feeding direction in the expanded state, and the left-side expansion support portion 50 extends left upward toward the upstream of the original-document feeding direction in the expanded state. This configuration makes it possible to support the original document with a wide area along the width direction at the upstream of the original-document feeding direction.

In addition, in the right-side expansion support portion 40 and the left-side expansion support portion 50, the handle portions (43*b*, 53*b*) provided at the free end of the third expansion portion are exposed in the half-expanded state (in the state in FIG. 8) in which the first expansion portion is expanded and the second expansion portion and the third expansion portion are accommodated. Furthermore, in the left-side expansion support portion 50, in the half-expanded state (in the state in FIG. 8), by displacing the handle portion 53*b* of the third expansion portion 53 in a first direction that is a direction away from the right-side expansion support portion 40, that is, in the +X direction, the second expansion portion 52 and the third expansion portion 53 are expanded in a region (region more toward the +X direction than the position X2) in the first direction relative to the rotary shaft 51*a* that is the center of rotation of the second expansion portion 52. In addition, in the right-side expansion support portion 40, in the half-expanded state (in the state in FIG. 8), by displacing the handle portion 43*b* of the third expansion portion 43 in a second direction that is a direction away from the left-side expansion support portion 50, that is, in the −X direction, the second expansion portion 42 and the third expansion portion 43 are expanded in a region (region more toward the −X direction than the position X1) in the second direction relative to the rotary shaft 41*a* that is the center of rotation of the second expansion portion 42.

With this configuration, when the left-side expansion support portion 50 is expanded, the right-side expansion support portion 40 is less likely to be an obstacle, which leads to an improvement in operability. This similarly applies to the right-side expansion support portion 40. With this configuration, either of the left-side expansion support portion 50 and the right-side expansion support portion 40 is less likely to be an obstacle to the other, which leads to an improvement in operability.

Furthermore, in addition to the first state illustrated in FIG. 11, the expansion support portion can take a second state illustrated in FIG. 12 as the expanded state. The reference character P1 in FIG. 11 represents an A4-size original document specified in the international standard ISO 216, by way of example. In this state, the right-side expansion support portion 40 extends right upward and the left-side expansion support portion 50 extends left upward. Thus, it is possible to appropriately support the original document P1 in a wide area of the width direction.

However, in this state, it is not possible to appropriately support an original document P2 (see FIG. 12) having a small dimension in the width direction. For this reason, the right-side expansion support portion 40 and the left-side expansion support portion 50 are configured such that the first expansion portion rotates relative to the upper opening/closing section 10 to be able to take the second expanded state as illustrated in FIG. 12. In other words, the expansion support portion can be switched between the first state in which the expansion support portion straightly extend in a direction intersecting the original-document feeding direction and the second state in which the expansion support portion straightly extends along the original-document feeding direction.

Thus, by setting the expansion support portion to be in the second state, it is possible to appropriately support the original document P2 having a small dimension in the width direction.

Note that, in the present embodiment, the expansion support portion is configured so as to be able to take the two states of the first state and the second state as the expanded state. However, the configuration is not limited to this. It may be possible to employ a configuration in which the expansion support portion can take only one expanded state or can take three or more expanded states. In addition, by employing a configuration in which the expanded state of the first expansion portion is maintained by using a frictional force occurring with the frame 10*a*, it is possible to seamlessly adjust the rotational angle of the first expansion portion relative to the upper opening/closing section 10.

Furthermore, in the present embodiment, the expansion support portion includes three expansion portion: the first expansion portion, the second expansion portion, and the third expansion portion. However, the expansion support portion may be comprised of the first expansion portion and the second expansion portion, or may include one or more expansion portions in addition to the three expansion portions.

In addition, in the present embodiment, the expansion support portion is configured such that each of the expansion portions straightly extends in the expanded state. However, the configuration is not limited to this.

Furthermore, in the present embodiment, the second expansion portion rotates relative to the first expansion portion to be able to be accommodated and expanded. In addition, the third expansion portion rotates relative to the second expansion portion to be able to be accommodated and expanded. However, the configuration is not limited to this. For example, it may be possible to employ a configuration in which any of the expansion portions is configured as a slide type, and by sliding the expansion portion, the expansion portion can be accommodated and the expanded. Furthermore, the rotation-type structure and the slide-type structure may be mixed.

In addition, in the present embodiment, the expansion support portion includes a plurality of expansion support portions, in other words, is comprised of the right-side expansion support portion 40 and the left-side expansion support portion 50. However, only either one of the right-side expansion support portion 40 and the left-side expansion support portion 50 may be provided.

Next, a left sub-edge guide 84 provided at the left edge guide 83 will be described with reference to FIGS. 18 and 19. Note that a right sub-edge guide is also provided at the right edge guide 80 as with the left edge guide 83. However, both the left and the right edge guides have the same basic configuration. Thus, only the left edge guide 83 and the left sub-edge guide 84 will be described below.

The left sub-edge guide 84 is provided rotatably at the left edge guide 83 through a rotary shaft 84*b*. The center line of the rotary shaft of the left sub-edge guide 84 is parallel to the X-axis direction.

Figure 19B:
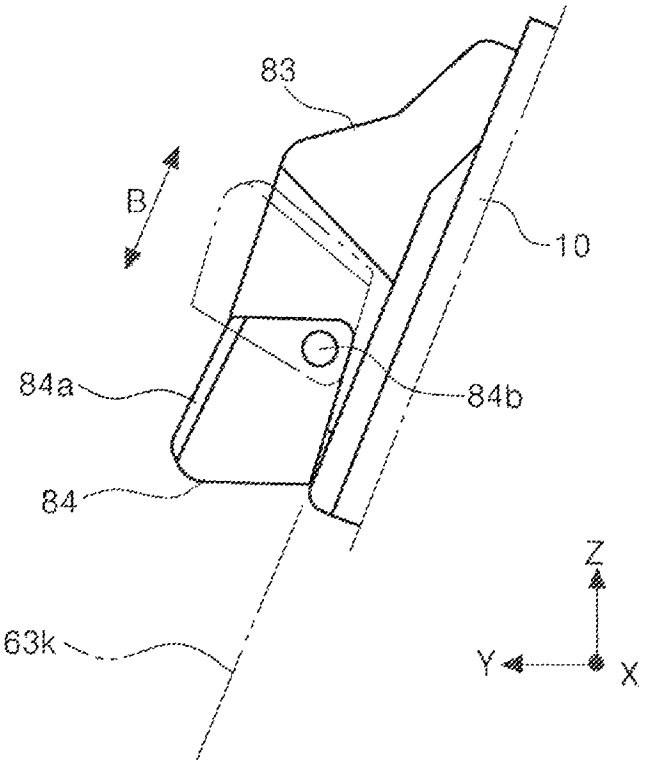
FIG. 19B is a side view illustrating a state in which the left sub-edge guide is expanded relative to the left edge guide.
Figure 19A:
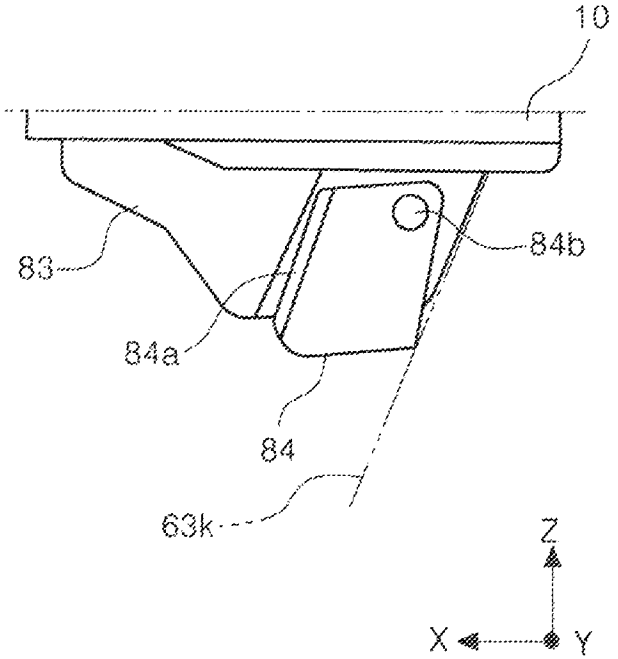
FIG. 19A is a side view illustrating a state in which the left sub-edge guide is accommodated relative to the left edge guide.

FIG. 19A illustrates a state in which the upper opening/closing section 10 is closed. In the state in which the upper opening/closing section 10 is closed, the left sub-edge guide 84 is in contact, by its own weight, with a path forming surface 63*k* formed at the first frame 63. The path forming surface 63*k* is a surface that constitutes the original-document feeding path R1 (see FIG. 5). Note that the left sub-edge guide 84 may be pressed toward the path forming surface 63*k* by a pressing member such as a spring.

When the upper opening/closing section 10 is opened from this state, the upper opening/closing section 10 is opened while the left sub-edge guide 84 is being maintained in a state of being in contact with the path forming surface as illustrated in FIG. 19B. This extends the length (length in the direction of the arrow B) related to guiding the side edge of the original document, which makes it possible to appropriately guide the side edge of the original document. In addition, in a state in which the upper opening/closing section 10 is closed, the left sub-edge guide 84 is in a state of being accommodated relative to the left edge guide 83 as illustrated in FIG. 19A. In other words, in a state in which the upper opening/closing section 10 is closed (FIG. 19A), it is not possible to sufficiently obtain the length of the left edge guide 83 in the Y-axis direction. Thus, only with the left edge guide 83, the length (length in the direction of the arrow B) relating to guiding the side edge of the original document is not sufficient when the upper opening/closing section 10 is opened. However, as described above, the left sub-edge guide 84 is provided so as to be able to rotate relative to the left edge guide 83. This configuration makes it possible to sufficiently obtain the length relating to guiding the side edge of the original document while reducing the size of the device.

Figure 18:
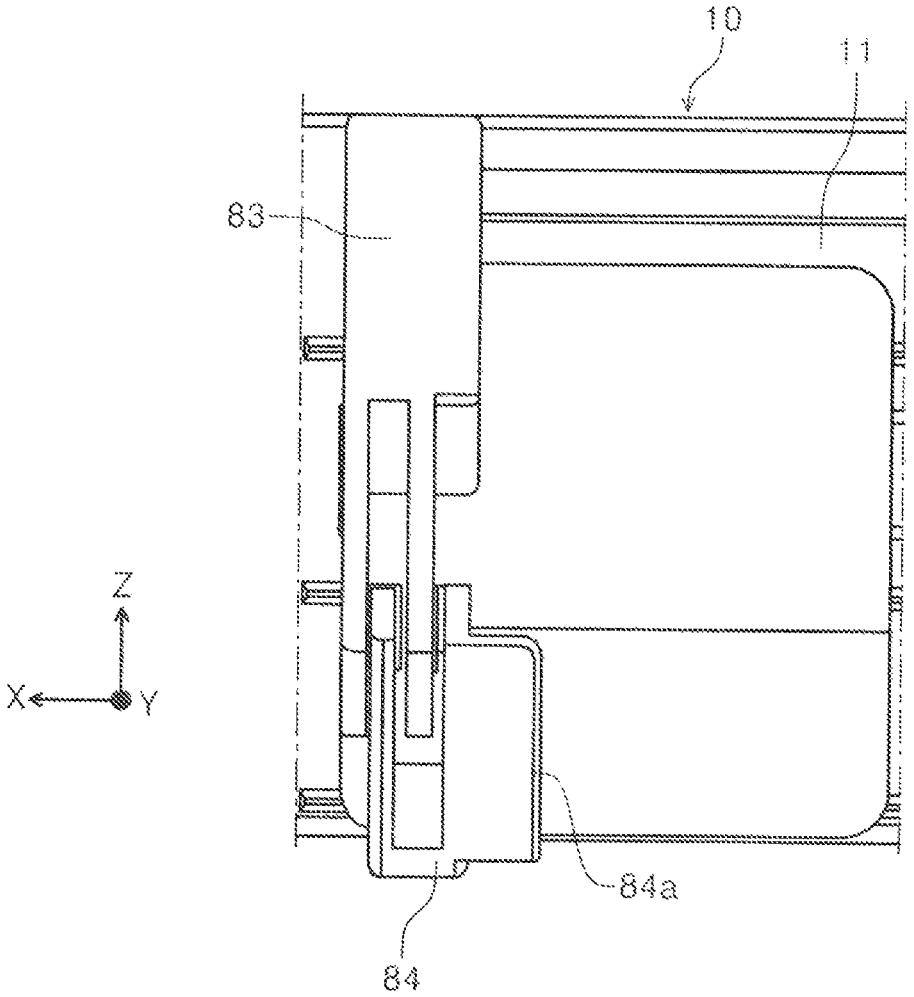
FIG. 18 is a plan view illustrating a state in which a left sub-edge guide is expanded relative to a left edge guide.

Note that an overhanging portion 84*a* is formed at the left sub-edge guide 84 as illustrated in FIG. 18. The overhanging portion 84*a* is formed so as to cover, from above, the side end region of the original document. The overhanging portion 84*a* makes it possible to restrict the height of loaded original documents supported by the original-document support face 11.

The present disclosure is not limited to the embodiment described above. Various modifications are possible within the disclosure described in the Scope of Claims. It is needless to say that these should be included in the scope of the present disclosure.

For example, the embodiment described above has been described by giving an example in which the embodiment is applied to an image reading device typified by a scanner. However, the embodiment can be applied to a recording device typified by a printer. In other words, by setting the original document in the embodiment described above as a target recording medium and setting the reading unit as a recording unit configured to perform recording on the target recording medium, the recording device can obtain operation and effects similar to those of the embodiment described above. One example of the recording device includes an inkjet printer. One example of the recording unit includes an ink jet-type recording head.

What is claimed is:

1. An image reading device comprising:

a device main body including a reading unit configured to read an image at an original document that is conveyed;

an original-document support portion disposed upstream of the reading unit and configured to support the original document that is to be fed; and an expansion support portion configured to be accommodated in and expanded from the original-document support portion, wherein the expansion support portion is expanded from the original-document support portion to support, together with the original-document support portion, the original document to be fed, wherein the expansion support portion includes:

a first expansion portion extending along a width direction, wherein the width direction is a direction intersecting an original-document feeding direction, the first expansion portion extends along the width direction in a state of being accommodated in the original-document support portion, and the first expansion portion being configured to rotate relative to the original-document support portion, thereby being expanded from and accommodated in the original-document support portion;

a second expansion portion extending along the width direction in a state where the expansion support portion is accommodated in the original-document support portion, wherein the second expansion portion being configured to be accommodated in and expanded from the first expansion portion; and a third expansion portion configured to be accommodated in and expanded from the second expansion portion, the third expansion portion extending along the width direction in a state in which the expansion support portion is accommodated, wherein the second expansion portion is further configured to rotate relative to the first expansion portion, the second expansion portion being expanded from and accommodated in the first expansion portion, and the third expansion portion is further configured to rotate relative to the second expansion portion, the third expansion portion being expanded from and accommodated in the second expansion portion, wherein the image reading device further comprises two of the expansion support portions sandwiching a center position, in the width direction, of the original-document support portion, when the original-document support portion is viewed from a front, the expansion support portion at a right side relative to the center position is referred to as a right-side expansion support portion, the expansion support portion at a left side relative to the center position is referred to as a left-side expansion support portion, the right-side expansion support portion extends right upward toward upstream in the original-document feeding direction in an extended state, the left-side expansion support portion extends left upward toward upstream in the original-document feeding direction in an extended state, and a free end of the third expansion portion is exposed in a half-expanded state, wherein in the half-expanded state the first expansion portion is expanded, and the second expansion portion and the third expansion portion are accommodated in the right-side expansion support portion and the left-side expansion support portion, in the left-side expansion support portion, by displacing, in the half-expanded state, the free end of the third expansion portion in a first direction that is a direction away from the right-side expansion support portion, the second expansion portion and the third expansion portion are expanded in a region at a side of the first direction relative to a center of rotation of the second expansion portion, and in the right-side expansion support portion, by displacing, in the half-expanded state, the free end of the third expansion portion in a second direction that is a direction away from the left-side expansion support portion, the second expansion portion and the third expansion portion are expanded in a region at a side of the second direction relative to the center of rotation of the second expansion portion.

2. The image reading device according to claim 1, wherein the right-side expansion support portion and the left-side expansion support portion are further configured to be switched between a first state and a second state by rotation of the first expansion portion relative to the original-document support portion, the first state being a state of extending straight in a direction intersecting the original-document feeding direction, and the second state being a state of extending straight along the original-document feeding direction.

3. The image reading device according to claim 1, wherein the original-document support portion is further configured to rotate relative to the device main body to switch between a state of being accommodated in the device main body and a state of supporting the original document.

* * * * *